US007901270B2

(12) United States Patent
Bechtold et al.

(10) Patent No.: US 7,901,270 B2
(45) Date of Patent: Mar. 8, 2011

(54) METHOD AND APPARATUS FOR PRECISION POLISHING OF OPTICAL COMPONENTS

(75) Inventors: Michael J. Bechtold, Ontario, NY (US); Darryle E. Fowler, Shortville, NY (US); David E. Mohring, Ontario, NY (US); Thomas Williams, Webster, NY (US); Robert Henderson, Livonia, NY (US); Alex DiNicola, Webster, NY (US); Christopher Wood, Webster, NY (US); Joseph P. Meisenzahl, East Rochester, NY (US); Scott Bambrick, Rochester, NY (US)

(73) Assignee: Optipro Systems, LLC, Ontario, NY (US)

( * ) Notice: Subject to any disclaimer, the term of this patent is extended or adjusted under 35 U.S.C. 154(b) by 0 days.

(21) Appl. No.: 12/683,471

(22) Filed: Jan. 7, 2010

(65) Prior Publication Data

US 2010/0112902 A1 May 6, 2010

Related U.S. Application Data

(63) Continuation of application No. 11/743,333, filed on May 2, 2007, now Pat. No. 7,662,024.

(60) Provisional application No. 60/746,346, filed on May 3, 2006.

(51) Int. Cl.
*B24B 13/00* (2006.01)
*B24B 21/02* (2006.01)

(52) U.S. Cl. ..... 451/11; 451/310; 451/307; 451/42

(58) Field of Classification Search ..... 451/307, 451/303, 310, 311, 296, 11, 42, 59
See application file for complete search history.

(56) References Cited

U.S. PATENT DOCUMENTS

| | | | |
|---|---|---|---|
| 1,367,808 | A | 2/1921 | Farrington |
| 2,612,007 | A | 9/1952 | Bell |
| 3,043,061 | A | 7/1962 | Plummer |
| 3,149,441 | A | 9/1964 | Hess |
| 3,524,284 | A | 8/1970 | Mears |
| 4,993,190 | A | 2/1991 | Hiyoshi et al. |

(Continued)

FOREIGN PATENT DOCUMENTS

| | | |
|---|---|---|
| DE | 100 31 057 A1 | 1/2002 |

*Primary Examiner*—Robert Rose
(74) *Attorney, Agent, or Firm*—Patent Innovations LLC; John M. Hammond

(57) ABSTRACT

A method of polishing objects using an apparatus comprised of a rotary positioning device comprising a turret; a base mounted on the turret; a drive wheel connected to a rotatable shaft, the drive wheel having a perimeter, and the rotatable shaft disposed in a housing. The polishing wheel assembly may include an elongated arm including a proximal end joined to the base, and a distal end; a rotatable polishing wheel supported at the end of the elongated arm; and a polishing belt comprising an inner surface and an outer surface, the inner surface engageable with the perimeters of the drive wheel and the polishing wheel. The method is comprised of contacting the outer surface of the polishing belt to a contact region of the surface of the object; and controlling the contact region by rotating the elongated arm around the turret axis.

20 Claims, 21 Drawing Sheets

U.S. PATENT DOCUMENTS 5,367,835 A 11/1994 Turnbull
5,951,375 A 9/1999 Mandler
6,796,877 B1 9/2004 Bingham et al.
2005/0079812 A1 4/2005 Bechtold

METHOD AND APPARATUS FOR PRECISION POLISHING OF OPTICAL COMPONENTS

CROSS-REFERENCE TO RELATED PATENT APPLICATIONS

This application is a continuation application of copending patent application Ser. No. 11/743,333, filed on May 2, 2007, which claims priority from U.S. provisional patent application Ser. No. 60/746,346 filed May 3, 2006, the entire disclosures of which are incorporated herein by reference.

STATEMENT REGARDING FEDERALLY SPONSORED RESEARCH OR DEVELOPMENT

This invention was made with government support under one or more of Contract Numbers W31P4Q-05-C-R048 and W31P4Q-04-C-R101 awarded by the Defense Advanced Research Projects agency (DARPA); and Contract Numbers N41756-05-M-1390 and N68936-06-C-0010 awarded by the Navy Engineering Logistics Office and NAVAIR. The government has certain rights in this invention.

This invention relates in one embodiment to a method and apparatus for polishing objects, and more particularly to a method and apparatus for polishing optical elements.

BACKGROUND OF THE INVENTION

1. Field of the Invention

A method and apparatus for correcting surface errors, and for polishing objects comprising a wide variety of materials and shapes including precision optical surfaces and injection mold inserts having plano, concave, convex, spherical, and other complex surfaces.

2. Description of Related Art

Currently, many optical lenses are made beginning with a "blank" starting part (such blank part being an approximately formed and generally roughly finished piece) in several processing steps. The process steps typically include fine grinding, followed by conventional polishing techniques wherein the surface roughness and surface accuracy of the lens is significantly improved. This prior art process is sufficient for many conventional low-precision lenses. However, when the desired lens has a shape that is not spherical or plano and/or where such conventional methodologies cannot be applied (e.g. to aspherics), or where the lens has very high accuracy requirements, such prior art process is not sufficient. In such circumstances, the method and apparatus of the present invention is advantageous.

Heretofore, a number of patents and publications have disclosed methods, apparatus, and compositions for polishing of precision surfaces. United States Patent Application Publication No. US 2004/0229553 A1 of Bechtold et al., which is assigned to the assignee of the present invention and incorporated herein by reference, describes a tool, apparatus, and method for polishing objects. The tool has a rotatable drive wheel engaged with a polishing wheel by use of a polishing foil formed as a flexible belt. The polishing wheel may have a cavity within, the cavity being inflatable using a variety of fluids having a range of physical properties. The polishing wheel is adjustably positionable against an object to be polished by actuating means joined thereto. The apparatus comprises a multi-axis computer controlled machine to which the tool is attached.

In some circumstances, is preferable to configure such an apparatus with a large diameter drive pulley, relative to the polishing wheel. This provides a large length of wrap of the polishing belt around the drive pulley so that it does not slip, and it also provides a high belt speed at a relatively low drive pulley rotational speed. However, if one configures the tool and apparatus of the published application of Bechtold et al. with a large driven pulley and a small polishing wheel, it is less capable of polishing deeply concave surfaces. This is because the angle formed by the straight lengths of belt between the drive pulley and the polishing wheel is large, and may even exceed 90 degrees. Thus the polishing wheel and abrasive belt can not be located within an object with a deeply concave surface, since the belt will rub on the edges of the object before the polishing wheel reaches the concave surface.

SUMMARY OF THE INVENTION

Accordingly, embodiments of the present invention are provided that meet at least one or more of the following objects of the present invention.

It is an object of this invention to provide an apparatus and method for precision polishing of objects of a wide variety of materials and shapes.

It is an object of this invention to provide a method, a tool, and an apparatus that has the ability to perform polishing of object surfaces that are deeply concave in shape.

This invention relates to a method and apparatus for correcting figure errors, and for polishing a wide variety of materials and shapes including but not limited to precision optical surfaces, injection mold cavities, thin film coating dies, and the like. The method of the present invention provides for improving and further finishing of a variety of surfaces, ranging from a relatively rough ground surface to a polished surface. The shape of the surfaces of the objects may include deeply concave surfaces.

Typically the part being finished according to the present invention is measured with a coordinate measurement machine (CMM), a surface profilometer, an interferometer, a microscope or some other measuring instrument capable of giving surface roughness and/or profile data. The data from such measurement and analysis is then entered into a machine process-controlling computer that then manipulates the data into process parameters for improving or polishing the desired component by a polishing machine of the present invention. One or more iterations of the process of the present invention may be required to achieve the desired results.

In the preferred embodiment, a polishing assembly comprising a driven abrasive belt is attached to and moved by a rotary positioning device of the polishing machine. The part to be improved or polished, whether spherical, aspherical or parabolic in shape, is placed into the work piece spindle of the polishing machine. If such part is not axially symmetrical, it may be held in a braked position in the work piece spindle, or held in a fixture on a table of the machine. The abrasive belt is then compressed against and traversed in a path over the component. Numerous variables are able to be controlled as process parameters, so that the desired finishing results are achieved.

In accordance with the present invention, there is provided a polishing apparatus comprising a base for affixing structures thereto, a drive wheel connected to a rotatable shaft, a polishing wheel assembly, a polishing belt, and at least one routing wheel engaged with the polishing belt. The rotatable shaft is disposed in a housing that is joined to the base or formed therein. The polishing wheel assembly includes an elongated arm including a distal end, a proximal end joined to the base, and a rotatable polishing wheel supported at the distal end of the elongated arm. The polishing belt is made with an abrasive outer surface that is applied to the object to perform the polishing, and an inner surface for engagement with the perimeters of the drive wheel and the polishing wheel. The routing wheel is engaged with the outer surface of the polishing belt, such that the contact arc of the polishing belt with the polishing wheel differs from an arc of the polishing wheel perimeter extending from a first tangent line between the drive wheel and the polishing wheel to a second tangent line between the drive wheel and the polishing wheel. The rotating shaft may be driven by an electric, pneumatic, or hydraulic motor, thereby rotating the drive wheel and advancing the polishing belt along the perimeter of the polishing wheel and along the object to be polished.

The polishing belt may be supplied from a supply spool, engaged with the polishing wheel, and wound up on a take-up spool. In the preferred embodiment, the polishing belt is a continuous loop of belt. The diameter of the drive wheel is preferably greater than the diameter of the polishing wheel. The contact arc of the polishing belt with the polishing wheel is greater than an arc of the polishing wheel perimeter extending from a first tangent line between the drive wheel and the polishing wheel to a second tangent line between the drive wheel and the polishing wheel. By configuring the polishing apparatus in this manner, the routing of the belt provides a sharper angle between the free spans of belt material. The apparatus is thus much more capable of reaching the recessed surface of a highly concave object such as a parabolic work piece, while having a wider range of tool paths and angles to polish such an object.

In one embodiment, the elongated arm of the polishing wheel assembly is comprised of a housing including a first portion and a second portion. Each of the housing portions comprise a proximal end and a distal end, with each of the distal ends including a socket formed therein. A first bearing is disposed between the socket of the first housing half and the polishing wheel, and a second bearing is disposed between the socket of the second housing half and the polishing wheel. The sockets may be cylindrically shaped for receiving bearings comprised of an outer race, an inner race, and a plurality of rolling members, such as balls (i.e. a ball bearing) or rollers (i.e. a roller bearing or needle bearing). Alternatively, the sockets may be substantially spherical shaped, for receiving bearings that are simply spherical balls.

The polishing wheel may be comprised of a rigid interior portion including the first socket and the second socket, and an elastic exterior portion. The perimeter of the polishing wheel may be arcuate shaped. The polishing wheel may have an elongated barrel or cylindrical shape having a ratio of length to diameter greater than one.

The polishing apparatus may further include a tensioning wheel engageable with the polishing belt for taking up slack in the belt at the beginning and during a polishing operation. The tensioning wheel may be engaged with the belt by a linear or rotary actuator that deploys the tensioning wheel against the inner or outer surface of the belt.

The polishing apparatus may further include a dressing assembly including a stripping surface that is contactable with the outer surface of the polishing belt. The stripping surface may be a stick of material or a rotating wheel that is applied to the polishing belt. In a preferred embodiment, the dressing assembly is comprised of a dressing belt having an outer surface that is the stripping surface. The dressing belt may be stored on and deployed from a supply spool and wound up on a take-up spool after engagement with the polishing belt outer surface.

The polishing apparatus may further include a polishing spot measurement tool comprised of a deployable housing containing a light source and a light detector. The tool is preferably retracted when not in use, and deployed by an actuator when a spot measurement is needed. The light source may be a super luminescent light emitting diode (SLED). The measurement is non-contact, i.e. the tool does not touch the surface of the polished spot being measured.

The polishing apparatus may further include polishing wheel position measuring device comprising a laser and a photodetector.

A computer numerically controlled (CNC) machine may be used to articulate the polishing wheel assembly against the surface of the object to be polished. The CNC machine may include a first linear slide movable along a first axis, disposed upon a machine platform; a second linear slide movable along a second axis, engaged with the first linear slide, with the second axis disposed orthogonally to the first axis; a third linear slide movable along a third axis, with the third axis disposed orthogonally to the first and second axes; and a first rotatable positioning device engaged with the third linear slide, the first rotatable positioning device being rotatable around an axis parallel to the second axis and further comprising a turret head. The base of the polishing apparatus is joined to the turret, thereby enabling the polishing wheel assembly to be articulated against the surface of the object to be polished. The CNC machine may further comprise a rotatable spindle for holding an object to be polished. The spindle may hold the object stationary or rotate the object as the polishing wheel and belt are moved along the surface of the object to be polished.

In accordance with the present invention, there is provided a method of polishing objects using an apparatus comprised of a rotary positioning device comprising a turret rotatable around a turret axis; a base for affixing structures thereto, the base mounted on the turret and comprising a plate having a surface defining a plane perpendicular to the turret axis; a drive wheel connected to a rotatable shaft, the drive wheel having a perimeter, and the rotatable shaft disposed in a housing joined to the plate and having a rotational axis that is substantially parallel to the turret axis; and a polishing wheel assembly. The polishing wheel assembly may be comprised of an elongated arm including a proximal end joined to the base, and a distal end; a rotatable polishing wheel supported at the distal end of the elongated arm, the rotatable polishing wheel having a perimeter; and a polishing belt comprising an inner surface and an outer surface, the inner surface engageable with the perimeters of the drive wheel and the polishing wheel. The method is comprised of contacting the outer surface of the polishing belt to a contact region of the surface of the object; and controlling the contact region by rotating the elongated arm around the turret axis.

The apparatus of the present invention and associated methods for using the apparatus are advantageous because the apparatus can be adapted for the polishing of a variety of materials and shapes, particularly those objects having deeply concave shapes. As a result of the invention, articles of manufacture such as precision optics, injection mold cavities, and thin film coating dies can be polished with high precision at a high throughput and low cost.

BRIEF DESCRIPTION OF THE DRAWINGS

The invention will be described by reference to the following drawings, in which like numerals refer to like elements, and in which.

Figure 1:
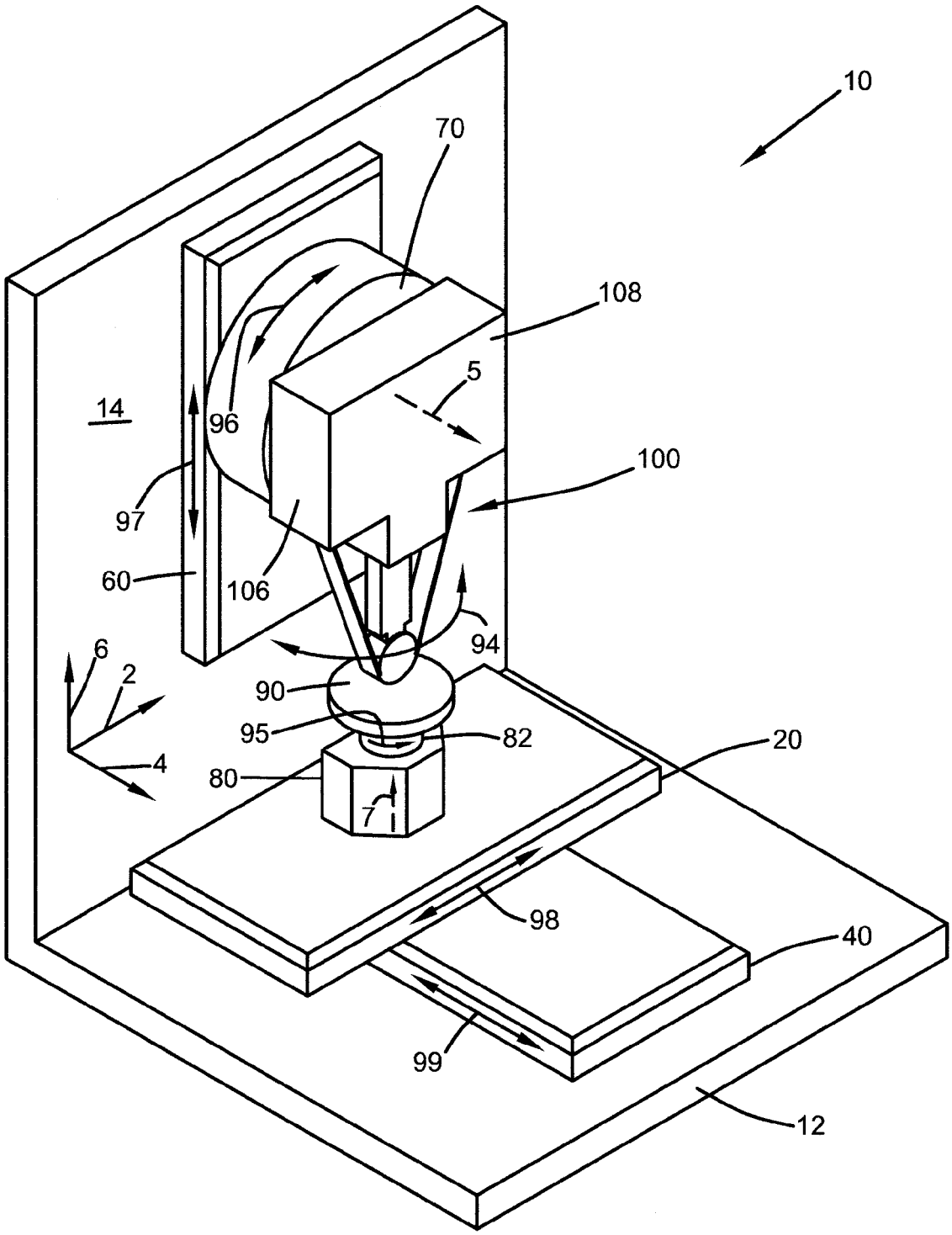
FIG. 1 is a perspective view of a computer numerically controlled machine that includes the polishing apparatus of the present invention.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENTS

For a general understanding of the present invention, reference is made to the drawings. In the drawings, like reference numerals have been used throughout to designate identical elements. In describing the present invention, a variety of terms are used in the description:

As used herein, the term figure error (or form error) is the measured global deviation from the desired surface shape e.g., a sphere, asphere or polynomial geometric shape.

As used herein, the term polishing, when used in reference to a work piece to be finished, is meant to indicate a chemical and/or mechanical process that ablates material from a surface.

In the following specification, for the sake of linguistic simplification, only optical components, also known as precision optics, or optics generally, are typically mentioned as the work piece. However, it is to be understood that all lenses, spherical and aspherical, conformal optics, mirrors, plano shapes, injection mold components, coating dies, and other articles of manufacture that require highly polished accurate surfaces are also included in the description, and are to be considered as being within the scope of the present invention. Materials that may be finished using the method and apparatus of the present invention include, but are not limited to brittle amorphous materials such as e.g., glass, ceramics, infrared materials such as quartz, visible light and ultraviolet light transmissive materials, and the like. Also included are metals such as e.g., tool steel, stainless steel, and the like; crystalline materials such as e.g. silicon; and any other work pieces requiring high finish and form specifications.

FIG. 1 is a perspective view of a machine that includes the polishing apparatus of the present invention. Machine 10 is preferably a computer numerically controlled (CNC) machine, and is described with respect to the orthogonal X axis 2, Y axis 4, and Z axis 6. A preferred orientation of machine 10 and the polishing apparatus 100 thereof with respect to the X, Y, and Z axes is as shown in FIG. 1. However, it is to be understood that machine 10 may be oriented and operated in positions other than as depicted in FIG. 1 with respect to horizontal X and Y axes 2 and 4 and the vertical Z axis 6.

Machine 10 comprises a machine platform 12 that supports Y-axis linear slide 40, the motion of which is bi-directional along Y-axis 4 as indicated by arrow 99. Linear slide 20, the motion of which is bi-directional along X-axis 2 as indicated by arrow 98, is mounted upon Y-axis linear slide 40. These linear slides 20 and 40 are preferably both computer numerically controlled (CNC) positioning devices, providing programmable motion of spindle 80 in the X-Y plane.

Machine 10 further comprises vertical slide 60 attached to polishing machine frame or plate 14, which is joined to platform 12. The motion of vertical slide 60 is bi-directional along Z-axis 6 as indicated by arrow 97. Machine 10 is preferably provided with turret 70, which is mounted upon vertical slide 60, and which is rotatable around B axis 5 (parallel to Y-axis 4) as indicated by bidirectional arcuate arrow 96. Polishing apparatus 100 of the present invention, to be described subsequently herein, is attached to turret 70.

Machine 10 further comprises a work piece spindle 80 mounted upon linear slide 20. Spindle 80 is a vertically disposed spindle, the central axis 7 of which may be parallel to Z-axis 6. Rotatable work piece chucking device 82 is attached to the end of work piece spindle 80. The work piece 90 to be polished is engaged and held by chuck 82 and may be rotated by spindle 80 around the central rotary axis 7 thereof as indicated by arrow 95. This spindle 80 is also a positioning/variable speed device which will allow for deterministic finishing of form errors that may not be rotationally symmetric such as astigmatism in a spherical optic through controlled slowing or speeding up of the rotation of spindle 80 during each revolution. The motion of spindle 80 is bidirectionally programmable along the X axis 2 and the Y axis 4.

Machine 10 further comprises a polishing apparatus 100 mounted on turret 70. A polishing wheel and polishing belt (to be described subsequently herein), which form part of polishing apparatus 100, may be brought into contact with work piece 90 by downward motion of vertical slide 60, and by rotary motion of turret 70 as indicated by arcuate arrow 94.

The motion of polishing apparatus 100 with respect to work piece 90, or work pieces of a variety of different shapes is thus fully programmable, and has great flexibility. Machine 10 may articulate apparatus 100 over the surface of object 90 in a complex path in X-Y-Z space. For example, apparatus 100 may be generally advanced along a linear path, but with a circular motion superimposed on such linear path. Such a tool path is known in the art as a trichordal path. Alternatively, such tool paths may include arcuate, zigzag, sinusoidal, or other combinations of motion so as to enhance the removal rate of material from object 90, and to prevent the occurrence of any "grooving" effect in the object surface during the polishing thereof.

Polishing assembly 100 is preferably configured with a large diameter drive pulley, relative to the polishing wheel. This provides a large length of wrap of the polishing belt around the drive pulley so that it does not slip, and it also provides a high belt speed at a relatively low drive pulley rotational speed. However, in order to enable the polishing apparatus 100 to access the recessed surfaces of deeply concave objects, polishing apparatus 100 is comprised of one or more additional routing wheels to provide the polishing belt with a large angle of wrap around the polishing wheel, and a highly acute angle formed by the two lengths of polishing belt immediately adjacent to the polishing wheel. This feature is best understood with reference to FIGS. 2A-3B, which depict various embodiments of polishing apparatus 100.

Figure 2A:
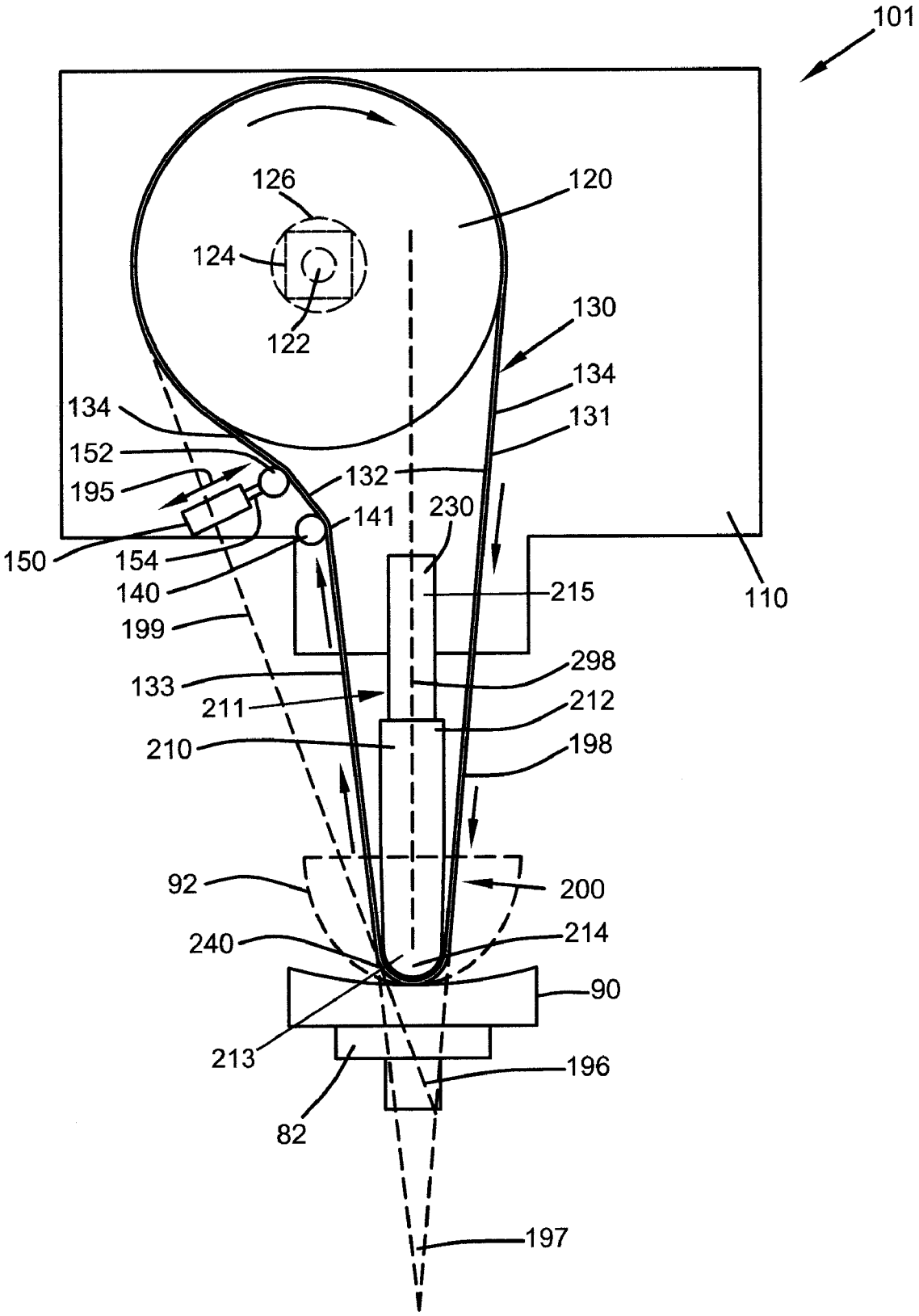
FIG. 2A is a front elevation view of a first embodiment of the polishing apparatus.

FIG. 2A is a front elevation view of a first embodiment 101 of the polishing apparatus 100. Apparatus 101 is comprised of a base 110 for affixing and/or supporting various objects thereto. Base 110 is preferably a rigid metal plate such as e.g., aluminum. Drive wheel 120 of apparatus 110 is joined to a rotatable shaft 122, which is disposed in a housing 124 that may be joined to the base 110, or formed therein. Housing 124 comprises a bushing or bearing(s) (not shown) so that shaft 122 is rotatable therein. The housing may be a separate bearing block that is joined to the housing, or if the base is sufficiently thick walled, the bearing housing may be formed in the base itself. Rotatable shaft 122 is driven by motor 126, or other suitable power transmission means, which may include various gears, pulleys, and other drive components (not shown). Drive wheel 120 is disposed on the outer side of base 110, while motor 126 and housing 124 (if separate from base 110) are disposed on the inner side, with rotatable shaft 122 passing through a hole (not shown) in base 110.

Apparatus 101 further comprises a polishing wheel assembly 200 comprised of an elongated arm 211 including a distal end 213, a proximal end 215 joined to the base, and a rotatable polishing wheel 240 supported at the distal end 213 of the elongated arm 211. In one embodiment, the elongated arm 211 of the polishing wheel assembly 200 is comprised of a housing 210 including a proximal end 212 and a distal end 214. The rotatable polishing wheel 240 is supported within the housing 210 at the distal end 214 thereof. Housing 210 is joined to base 110 by a support rod 230. A polishing belt 130 is fitted to apparatus 101 for the purpose of polishing work piece 90. Polishing belt 130 comprises an inner surface 132 and an outer surface 134. The inner surface 132 of belt 130 is engageable with the perimeters of the drive wheel 120 and the polishing wheel 240. The outer surface 134 of belt 130 is embedded with abrasive particles for performing the polishing material removal when contacted with the object 90.

Apparatus 101 further comprises at least one routing wheel 140 that is engaged with the outer surface 134 of the polishing belt 130. In general, the one or more routing wheels position the free span 131 of polishing belt that is approaching the polishing wheel and the free span 133 of polishing belt that is departing from the polishing wheel at a sharply acute angle to each other, or even substantially parallel to each other. By configuring the polishing apparatus 100-104 (FIGS. 1-3B) in this manner, the apparatus is this much more capable of reaching the recessed surface of a highly concave object such as a parabolic work piece, while having a wider range of tool paths and angles to polish such an object, as will be explained presently in more detail. This manner of configuring the polishing apparatus is particularly useful when the diameter of the drive wheel 120 is much larger than the polishing wheel 240 as shown in FIGS. 2A-3B; or when the drive wheel is offset from the longitudinal axis 298 of the elongated arm 211 of the polishing wheel assembly 200.

Thus in this configuration, when operating apparatus 101, routing wheel 140 is engaged with the outer surface 134 of the polishing belt 130 such that the contact arc of the polishing belt with the polishing wheel differs the contact arc that would occur if the polishing belt 130 were directly fitted to the drive wheel 120 and the polishing wheel 240 without one or more routing wheels. When no routing wheels are used, the contact arc of the belt on polishing wheel 240 extends from a first tangent line between the drive wheel and the polishing wheel (which would also be the position of the approaching free span of the polishing belt 130) to a second tangent line between the drive wheel and the polishing wheel (which would also be the position of the departing free span of polishing belt 130). It is beneficial to use one or more routing wheels to reposition the approaching and departing free spans of belt such that they are generally parallel to the z-axis, or such that the highly acute angle formed between them is approximately bisected by a line parallel to the z-axis. This results in a contact arc of the polishing belt 130 on the polishing wheel 240 having a center point at the "six-o'clock" position when the polishing machine is in its neutral starting position as shown in FIG. 1, with the longitudinal axis 298 of elongated arm 211 of the polishing wheel assembly 200 disposed vertically. This positioning of the contact arc centered at "six-o'clock" in turn provides the most versatile overall polishing capability, with the maximum possible range of tool paths that can be used on the object to be polished.

In one embodiment (not shown), belt 130 may be provided as a reel of material that is wound on a first spool. Belt 130 may be threaded through the polishing apparatus in a manner similar to that shown in apparatus 100-104 of FIGS. 2A-3B, except that the leading end of belt 130 is fastened to a take-up spool. Belt 130 is then used in a polishing operation in a reel-to-reel manner, such that any given location on belt 130 only makes a single pass over work piece 90. In another embodiment (not shown), belt 130 may be provided in a "cassette tape" like configuration. In operation, a long length of belt is unwound around a first spool, and wound up on a second spool after passage over the work piece. When the stored belt on the first spool is fully unwound and taken up on the second spool, the direction of the winding is reversed, and the belt is reused. In this manner, a large amount of reusable belt length may be provided for polishing. For both of these embodiments, one or more routing wheels are used to position the approaching span 131 of polishing belt 130, the departing span 133 of polishing belt 130, and the contact arc of polishing belt 130 on polishing wheel 240 in the optimum manner as described above.

In the preferred embodiment, the polishing belt is a continuous loop of belt, and the diameter of the drive wheel is greater than the diameter of the polishing wheel. In this embodiment, the one or more routing wheels are positioned such that the contact arc of the polishing belt 130 with the polishing wheel 240 is greater than the arc of the polishing wheel perimeter that extends from a first tangent line between the drive wheel 120 and the polishing wheel 240 to a second tangent line between the drive wheel 120 and the polishing wheel 240.

Referring again to FIG. 2A, routing wheel 140 engages with the outer surface 134 of the polishing belt 130 at a contact arc 141 that is disposed between a first tangent line 199 and a second tangent line 198 between the drive wheel 120 and the polishing wheel 240. In the embodiment 101 depicted in FIG. 2A, it can be seen that the second tangent line 198 in FIG. 2A is actually the portion 131 of the belt 130 between the drive wheel 120 and the polishing wheel 240. This is in contrast to the embodiment 102 of FIG. 2B, which is provided with first and second routing wheels, as will be describe subsequently herein. Additionally, in the embodiment 101 depicted in FIG. 2A, the contact arc of polishing belt 130 on polishing wheel 240 is greater than the arc of polishing wheel 240 that is between first tangent line 199 and a second tangent line 198 between the drive wheel 120 and the polishing wheel 240.

It can be seen that by providing routing wheel 140 engaged with the outer surface 134, polishing belt 130 is routed so that the angle 197 between the free span portions 131 and 133 of belt 130 is a highly acute angle. For example, angle 197 in FIG. 2A is about 10 degrees. In contrast, the angle 196 between tangent lines 199 and 198, which would be the angle between the free span portions 131 and 133 of belt 130 if routing wheel 140 were not present, is about 22 degrees. Thus the use of at least one routing wheel in routing the belt to provide a sharper angle between the free spans provides an apparatus that is much more capable of reaching the recessed surface of a highly concave object such as a parabolic work piece 92 depicted in FIG. 2A, while having a wider range of tool paths and angles to polish such an object.

In setting up apparatus 101, the polishing belt 130 may be sized for a snug fit to its path around drive wheel 120, polishing wheel 240, routing wheel 140, and various other routing wheels if such are used. In this instance, polishing belt 130 is stretched slightly in order to fit it over the wheels 120, 240, 140, etc. However, it is preferable that belt 130 be sized slightly longer than is needed to fit around drive wheel 120, polishing wheel 240, and within routing wheel 140 to enable easy fitting of belt 130. Support rod 230 of polishing wheel assembly 200 may be provided with slots (not shown) for engagement with fasteners (not shown), so that rod 230 may be slid downwardly away from drive wheel 120 to take up slack in belt 130 and engage it with portions of the perimeters of drive wheel 120 and polishing wheel 240.

However, it is preferable to provide an actuator that is operatively connected to a tensioning wheel to take up the slack of belt 130. The actuator may be controlled by the process control computer that runs the overall machine 10 (see FIG. 1). The actuator is preferably a simple linear actuator, but may also be a rotary actuator, or other cam-type mechanism that displaces the tensioning wheel toward polishing belt 130. The tensioning wheel may be disposed such that it engages with the inner surface 132 or the outer surface 134 of polishing belt 130, depending upon the overall design of the polishing apparatus. One exemplary belt tensioning arrangement is depicted in FIG. 2A. Linear actuator 150 is operatively connected to tensioning wheel 152 by rod and yoke 154. Linear actuator 150 deploys and retracts tensioning wheel 152 to and from belt 130, as indicated by bidirectional arrow 195, providing belt tension when deployed, and slack when retracted.

Figure 2B:
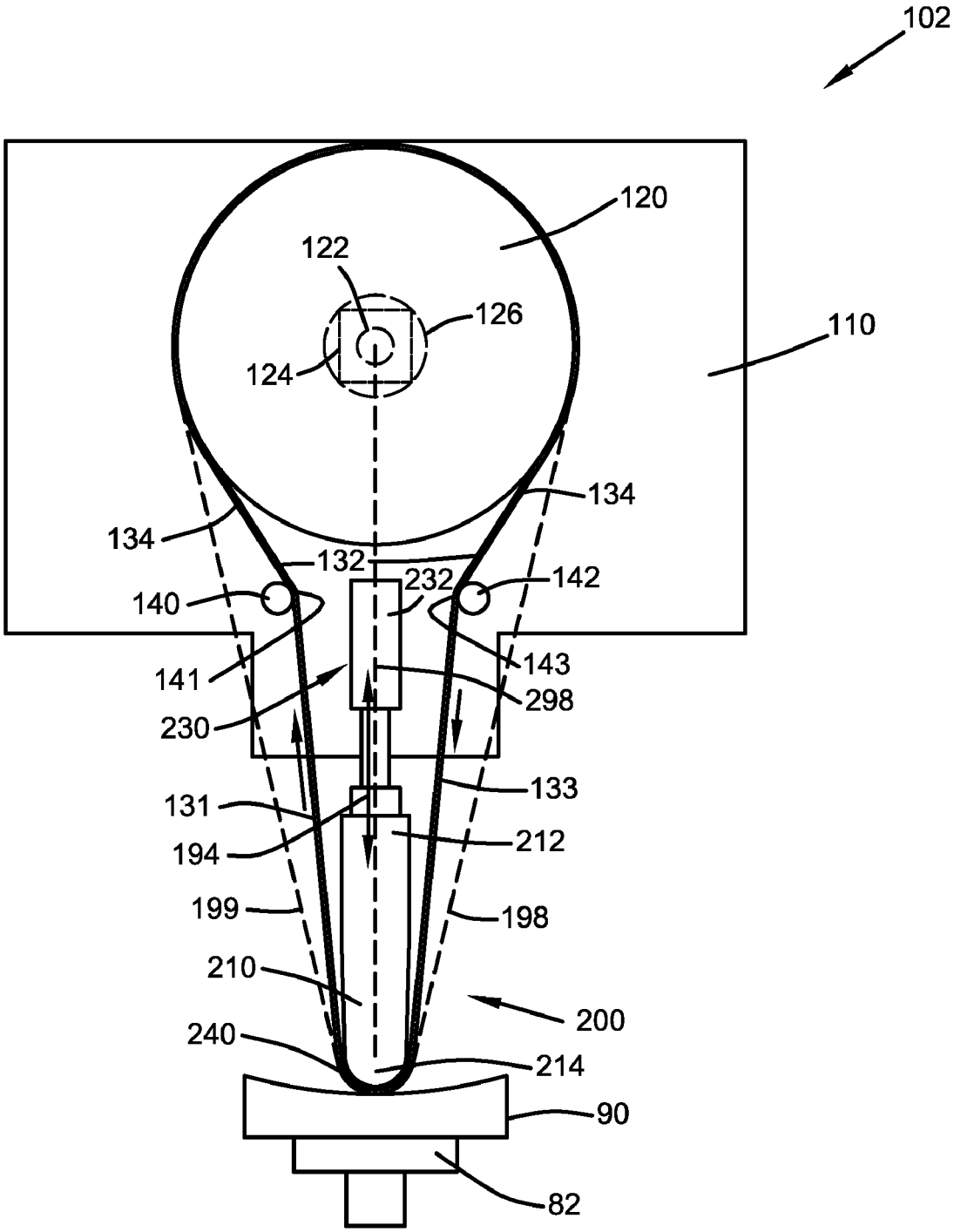
FIG. 2B is a front elevation view of a second embodiment of the polishing apparatus.

FIG. 2B is a front elevation view of a second embodiment 102 of the polishing apparatus 100. Polishing apparatus 102 is similar to polishing apparatus 101 of FIG. 2A, except that polishing apparatus 102 comprises two routing wheels 140 and 142 that guide belt 130 to provide a narrow angle between free spans 131 and 133 thereof. Additionally, elongated arm 211 is comprised of a linear actuator 232, which extends and retracts polishing wheel assembly 200 as indicated by arrow 194 in order to take up or provide slack in belt 130. It will be apparent that arm 230 could be provided as shown in FIG. 2A, with a linear actuator 150 and tension wheel 152 for the purpose of controlling belt slack. It can also be seen that the routing wheels 140 and 142 are positioned such that the contact arc of the polishing belt 130 with the polishing wheel 240 is greater than the arc of the polishing wheel perimeter that extends from the first tangent line 198 between the drive wheel 120 and the polishing wheel 240 to the second tangent line 199 between the drive wheel 120 and the polishing wheel 240.

Figure 3A:
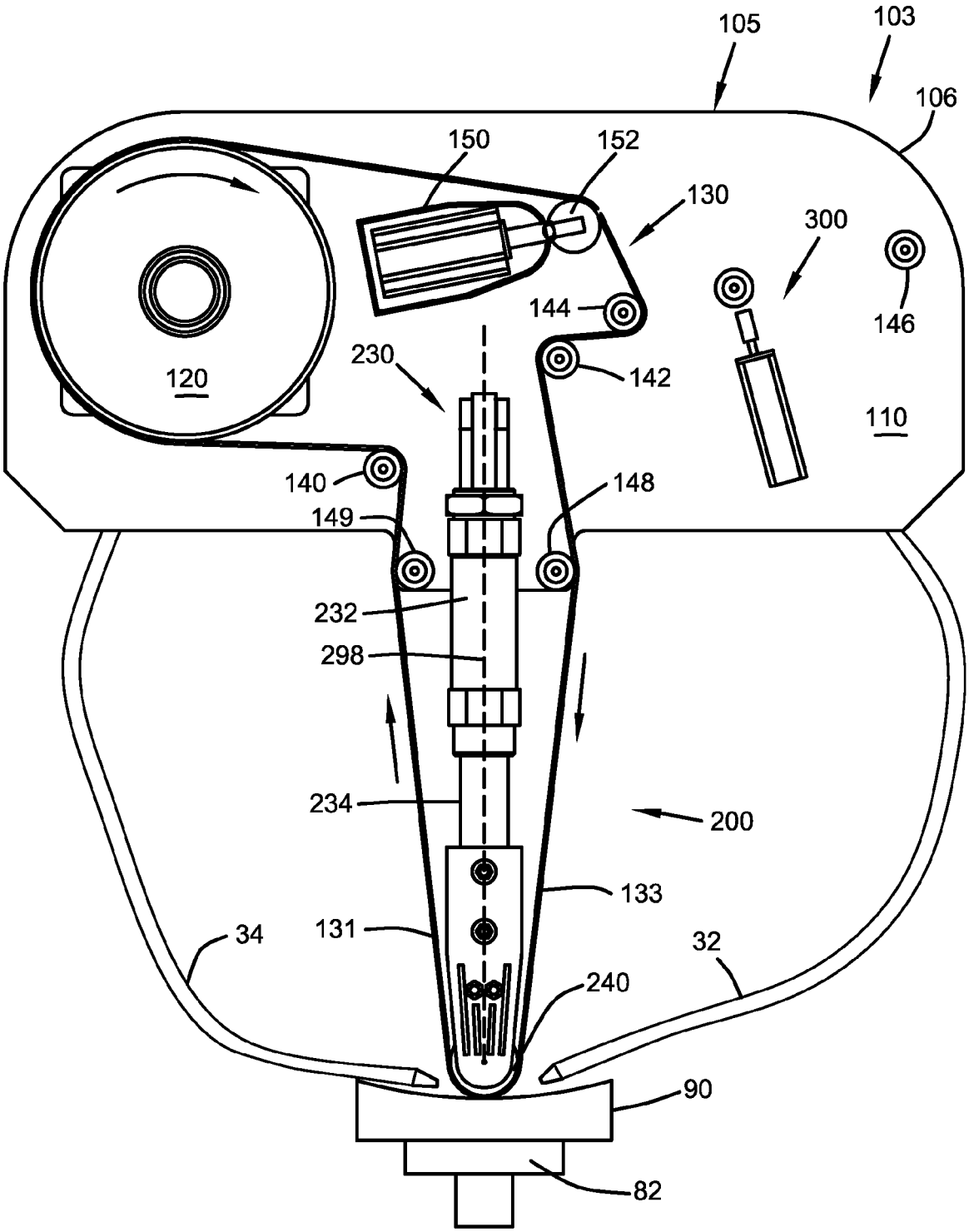
FIG. 3A is a front elevation view of a third embodiment of the polishing apparatus including additional guidance wheels and components to enable dressing of the polishing belt.
Figure 3B:
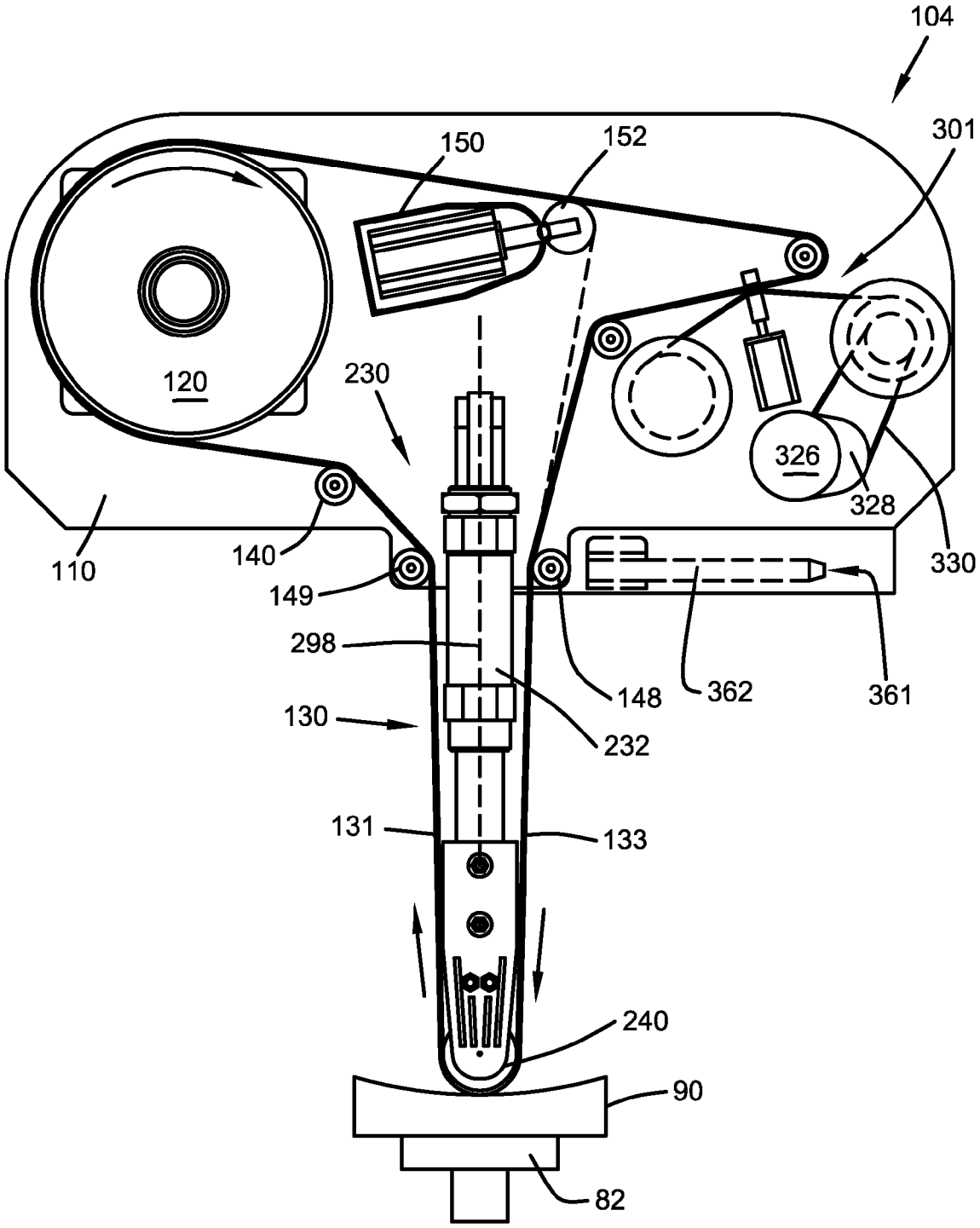
FIG. 3B is a front elevation view of a variant of the embodiment of FIG. 3B including spools of a secondary belt for dressing of the polishing belt.

FIGS. 3A and 3B are front elevation views of a third embodiment 103 and a fourth embodiment 104 of the polishing apparatus 100, including additional routing wheels and components to enable dressing of the polishing belt. Referring first to FIG. 3A, polishing apparatus 103 is housed in an enclosure 105, which is comprised of base 110, a horizontally extending wall 106, and cover 108 (FIG. 1), the shape of which is matched to mate with the outer edge of wall 106. Enclosure 105 isolates most of the moving polishing belt and wheels from the machine operator, thereby providing greater operator safety.

Polishing apparatus 103 is similar to polishing apparatus 101 and 102 of FIGS. 2A and 2B, and comprises two routing wheels 140 and 142 that guide belt 130; actuator 232, which extends and retracts polishing wheel assembly 200; and actuator 150, which is operatively connected to tensioning wheel 152. Belt 130 may thus be provided with additional slack. Actuator 232 may be used to take up the majority of the belt slack after polishing belt 130 is fitted to apparatus 103, with actuator 150 used to take up the remaining small amount of slack in order to engage belt 130 with drive wheel 120, polishing wheel 240, and the various guide wheels and other belt devices. Actuator 232 is operatively connected to polishing wheel assembly 200 by rod 234.

Apparatus 103 may further include routing wheels 148 and 149, the position of which may be adjusted in the horizontal direction to provide adjustability of the angle between belt free spans 131 and 133. In this embodiment, because of the particular arrangement of the belt 130 around routing wheels 140, 142, and 144, and tensioning wheel 152, routing wheels 148 and 149 are engaged with the inner surface of polishing belt 130. Apparatus 103 may further include guide wheels 144 and 146 to provide the capability of guiding belt 130 past or through additional belt treating devices, such as belt dresser 300 to be described subsequently herein.

FIG. 3B is a front elevation view of a variant of the embodiment of FIG. 3A including spools of a secondary belt for dressing of the polishing belt. Polishing apparatus 104 is similar to polishing apparatus 103 of FIG. 3A and may comprise a first routing wheel 140 that guides belt 130; actuator 232, which extends and retracts polishing wheel assembly 200; and actuator 150, which is operatively connected to tensioning wheel 152. Apparatus 104 may further include routing wheels 148 and 149. In this embodiment, routing wheels 148 and 149 are engaged with the outer surface 134 of polishing belt 130, thereby providing substantially parallel and more narrowly spaced belt free spans 131 and 133. Apparatus 103 may further include guide wheels 144 and 146 to provide the capability of guiding belt 130 past or through additional belt treating devices, such as belt dresser 301 to be described subsequently herein.

Figure 4:
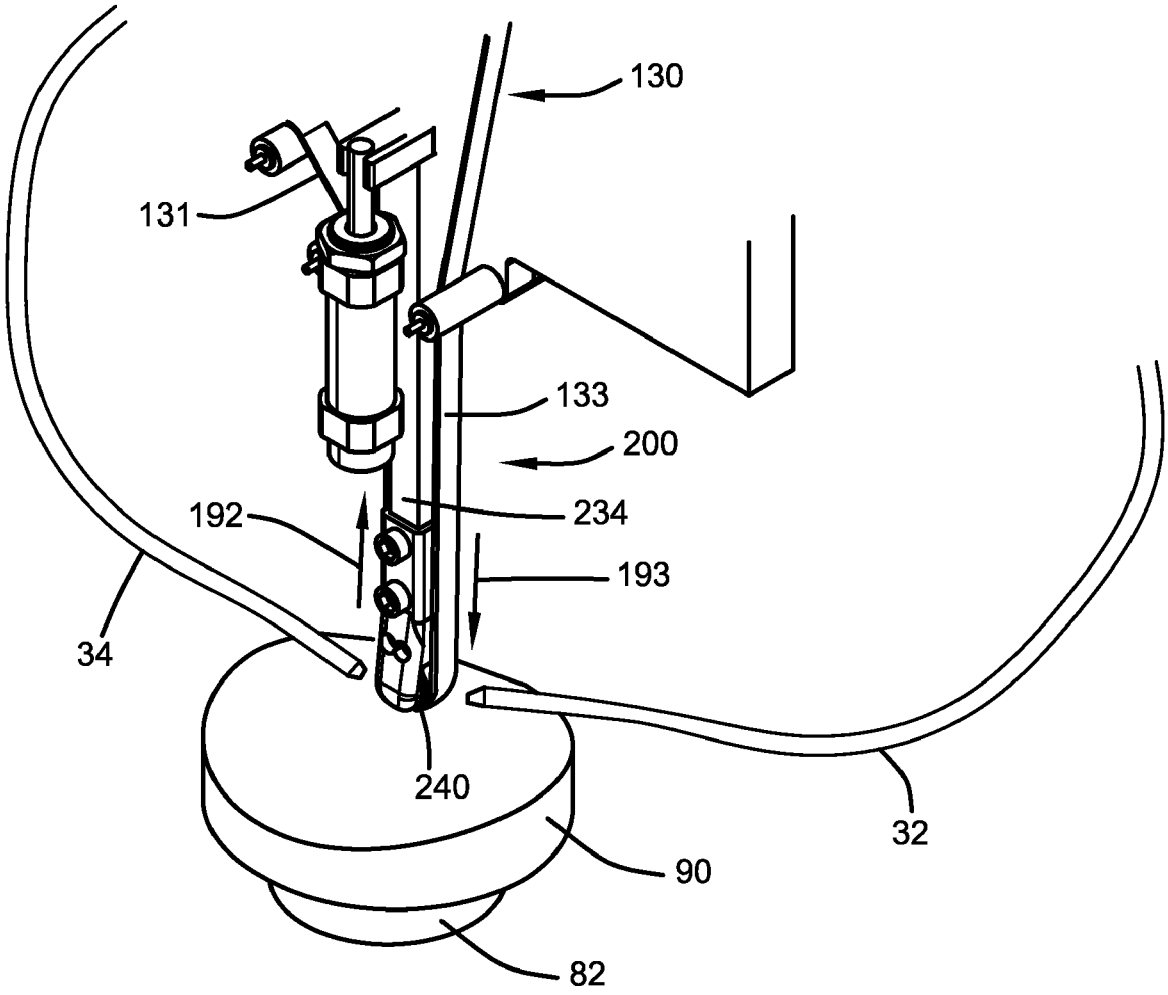
FIG. 4 is a perspective view that depicts the polishing of an object by the polishing apparatus.
Figure 5:
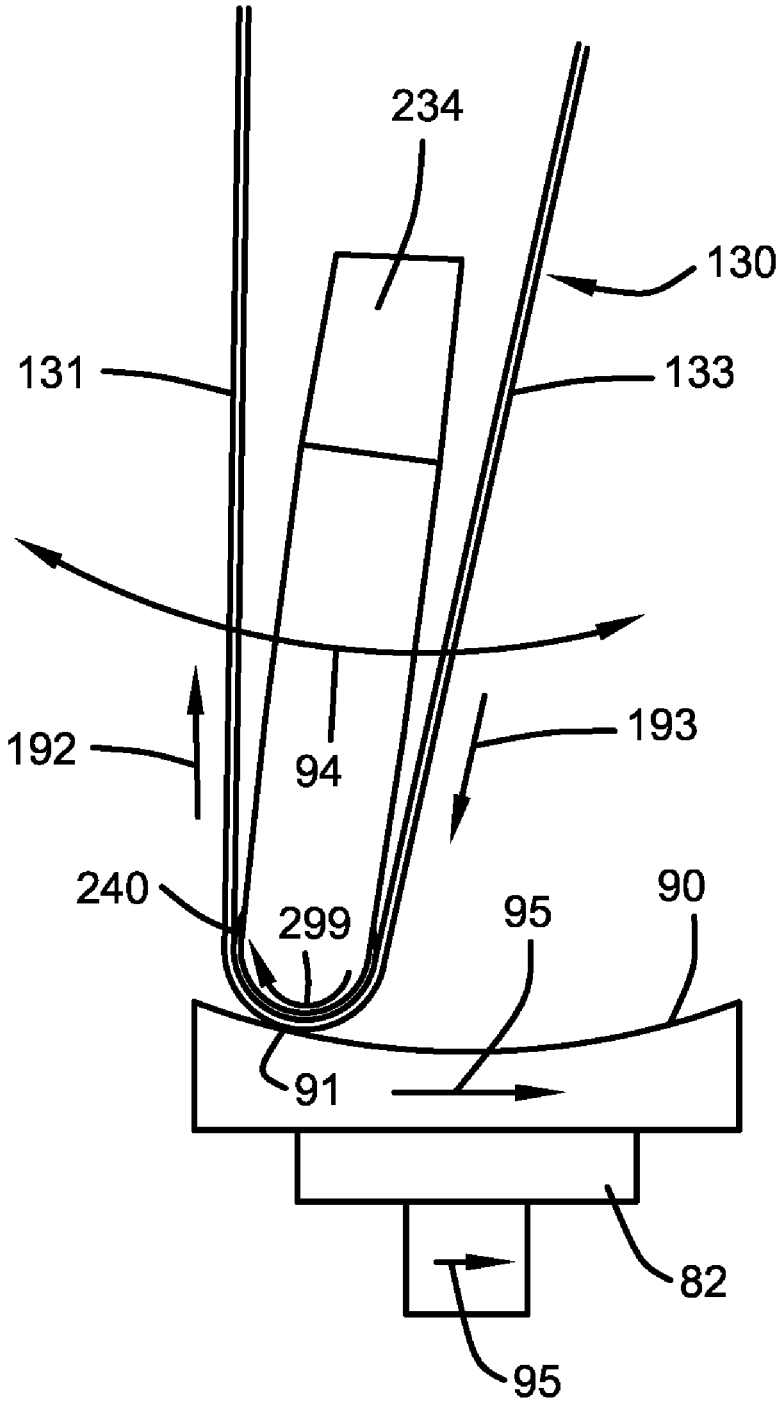
FIG. 5 is a front elevation view that depicts the polishing of an object having a concave surface by the polishing apparatus.

FIG. 4 is a perspective view that depicts the polishing of an object by the polishing apparatus, and FIG. 5 is a front elevation view that depicts the polishing of an object having a concave surface by the polishing apparatus. Polishing belt 130 is wrapped around and engaged with a portion of the perimeter of polishing wheel 240, such that the motion of belt 130 as indicated by arrows 193 and 192, result in the rotation of polishing wheel 240 as indicated by arcuate arrow 299. Polishing wheel 240 preferably has an elastic outer surface and deforms when pressed onto work piece 90. Polishing belt 130 thus contacts work piece 90 in a generally elliptical spot at contact region 91.

The size and shape of the spot, and the rate of material removal at contact region 91 depends upon a number of operating parameters, and can be measured by certain features of the apparatus, as will be described subsequently herein. The location of contact region 91 on work piece 90 is determined by the motion of polishing apparatus 100 in the x and y planes 2 and 4 (see FIG. 1), the rotation of the polishing apparatus 100 around axis 5 (see FIG. 1) as indicated by arcuate arrow 94, the positioning of work piece 90 along the z axis 6 (see FIG. 1) and the rotation of work piece 90 by spindle 80 as indicated by arrow 95.

Referring again to FIGS. 3A and 4, the polishing machine 10 may further comprise liquid supply tubes for delivering liquid materials to the polishing assembly and the work piece. Supply tube 32 may be used to deliver a liquid stream of coolant, such as water, or a typical machine tool coolant liquid. In one preferred embodiment, tube 32 is used to deliver a mist of air and fine water droplets. Supply tube 34 may be used to deliver a stream of abrasive polishing slurry, such as cerium oxide. Such a slurry may be used when polishing belt is not provided with abrasive particles on the outside surface or impregnated therein. In a further embodiment, a third fluid delivery tube (not shown) is provided so that machine 10 has the capability of providing abrasive slurry, liquid coolant, and an air/liquid mist coolant to the contact region 91 of the work piece.

With regard to the polishing apparatus 100-104 of FIGS. 1-3B, the actuators 152 and 232, and other actuators subsequently described herein may be pneumatic or hydraulic cylinders, rodless cylinders, stepper motors or other electromechanical actuators used to provide linear motion, either directly, or through rotational motion converted to linear motion such as by a cam or a coupled rod. Such actuators may be further provided with position sensing means, and/or position control means, and communication means for control thereof by an external process controller.

Suitable polishing belts may include the two piece polishing foil type belts comprised of an elastic inner band, and an abrasive ring outer band as disclosed in the aforementioned United States Patent Application Publication No. US 2004/0229553 A1 of Bechtold et al.

Alternatively, the polishing belt 130 may also be of unitary construction. Such a belt may be a solid band comprising multiple layers, including a structural layer of resin and fiber that provides structural strength and wear resistance needed to run on the various wheels without breaking or wearing; and an abrasive layer adhered or coated on the exterior, which provides the abrasive material used to polish the work piece 90. Examples of suitable single band polishing belts include belts comprising diamond, alumina, and/or silicon carbide particles. In one embodiment, a belt made of TRIZACT® abrasive manufactured and sold by the 3M Corporation (Minnesota Mining and Manufacturing) of St. Paul, Minn. is used. Depending upon the scale of polishing apparatus 100, the width of polishing belt 130 may vary from about 0.125 inch to about 4 inches. In preferred embodiments, the width of belt 130 is between about 0.375 inch and 1 inch.

Depending upon the particular setup of polishing apparatus 100, the circumference of belt 130 may be between about 20 inches and about 60 inches, although if polishing apparatus 100 is scaled up or down, belt 130 may need to be dimensioned outside of this range. A large circumference of belt 130 is advantageous from the standpoint of "abrasive capacity," i.e. belt 130 has a greater surface area to perform the polishing of the work piece 90, and thus does not wear out as quickly with the finishing of the work piece.

In the applicants' aforementioned U.S. provisional patent application Ser. No. 60/746,346, the applicants have described and shown in FIGS. 6-13 one embodiment of a polishing wheel assembly comprised of a first portion and a second portion, each of the housing portions comprise a proximal end and a distal end, with a polishing wheel disposed between bearings held in the distal ends of the housing portions. The entire disclosure of this provisional patent application is incorporated herein by reference.

Figure 6:
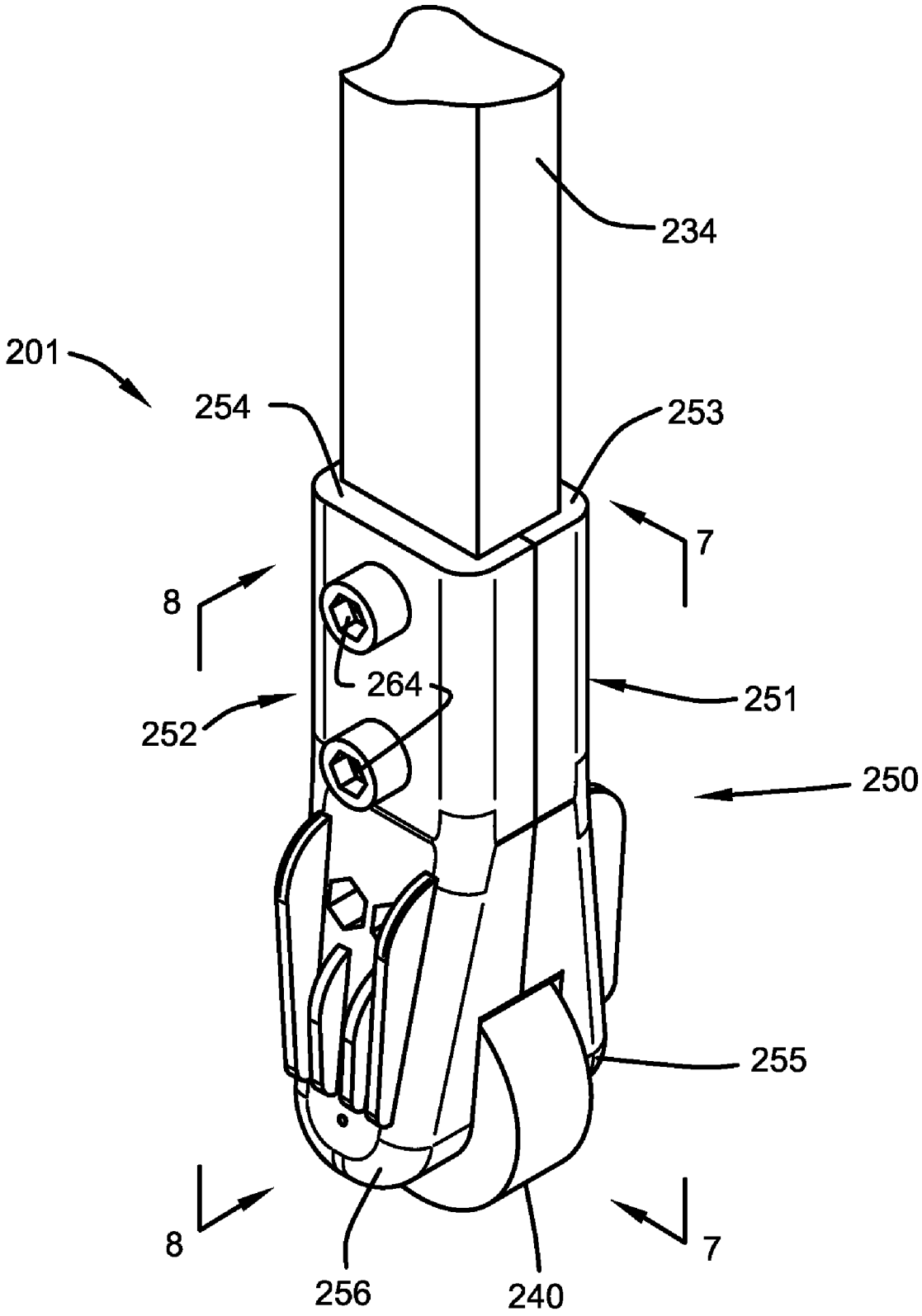
FIG. 6 is a perspective view of one polishing wheel assembly comprising a pair of spherical ball bearings.
Figure 7:
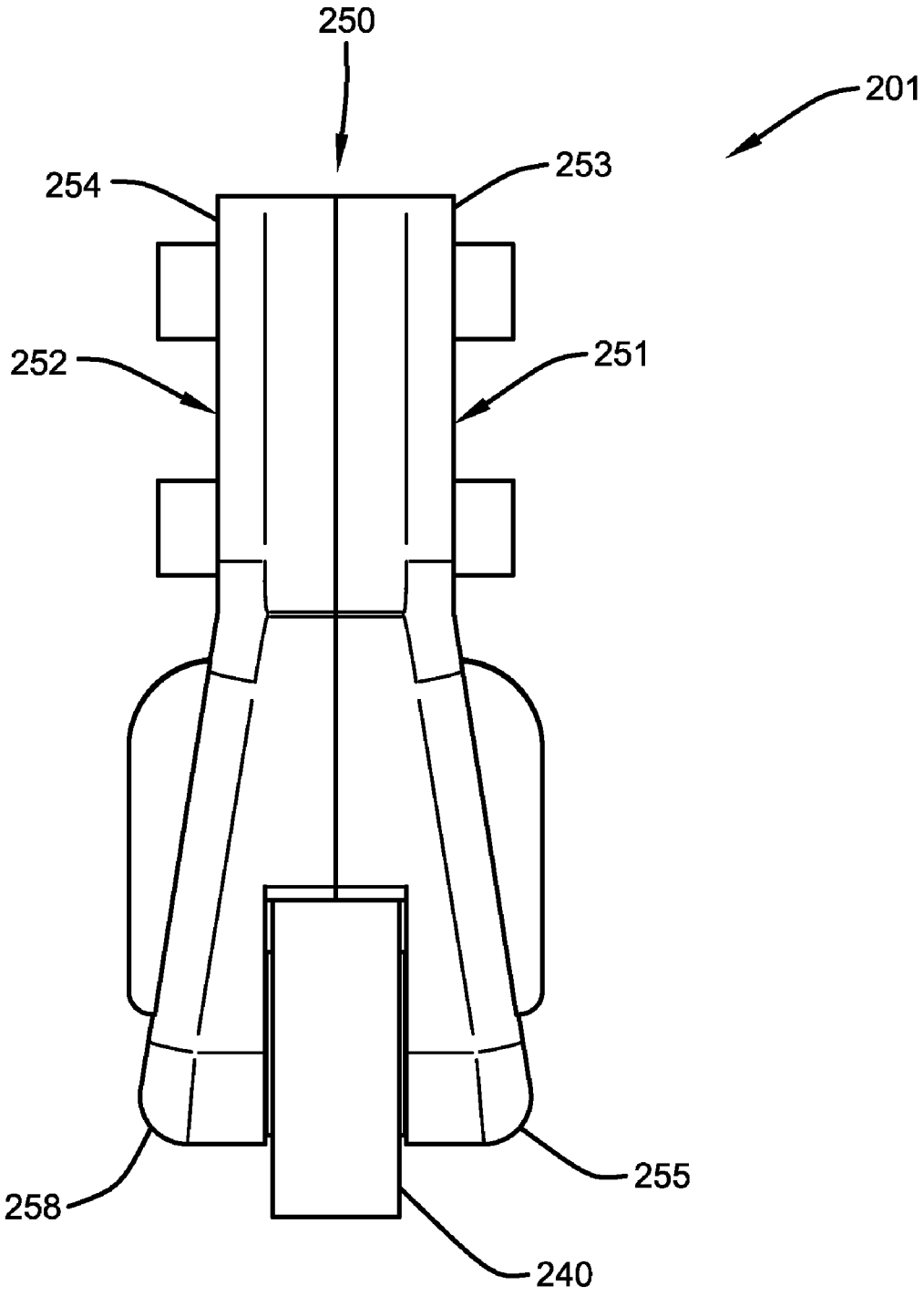
FIG. 7 is a side elevation view of the polishing wheel assembly of FIG. 5, taken along the line 7-7 of FIG. 6.
Figure 8:
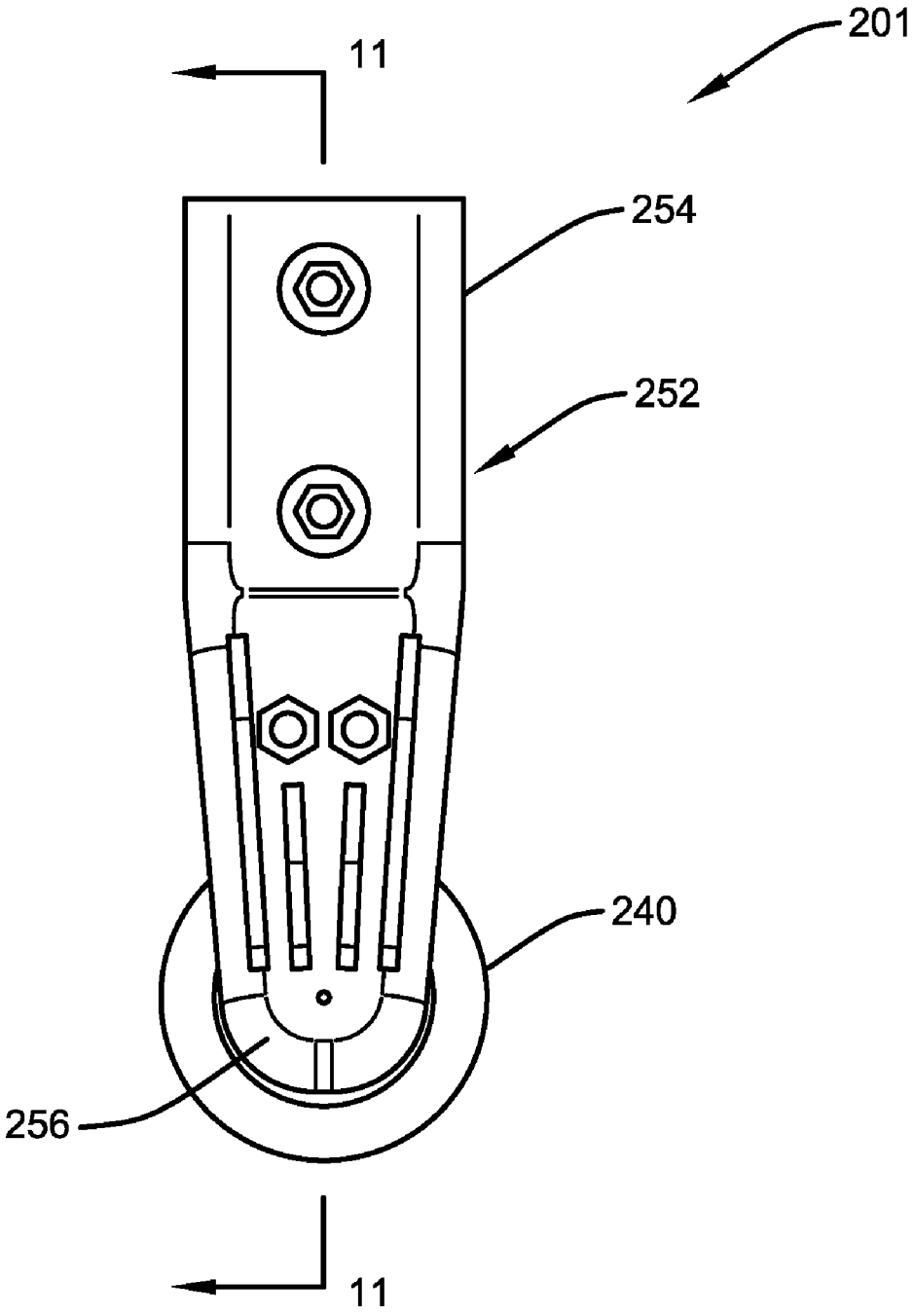
FIG. 8 is a front elevation view of the polishing wheel assembly of FIG. 5, taken along the line 8-8 of FIG. 6.
Figure 9:
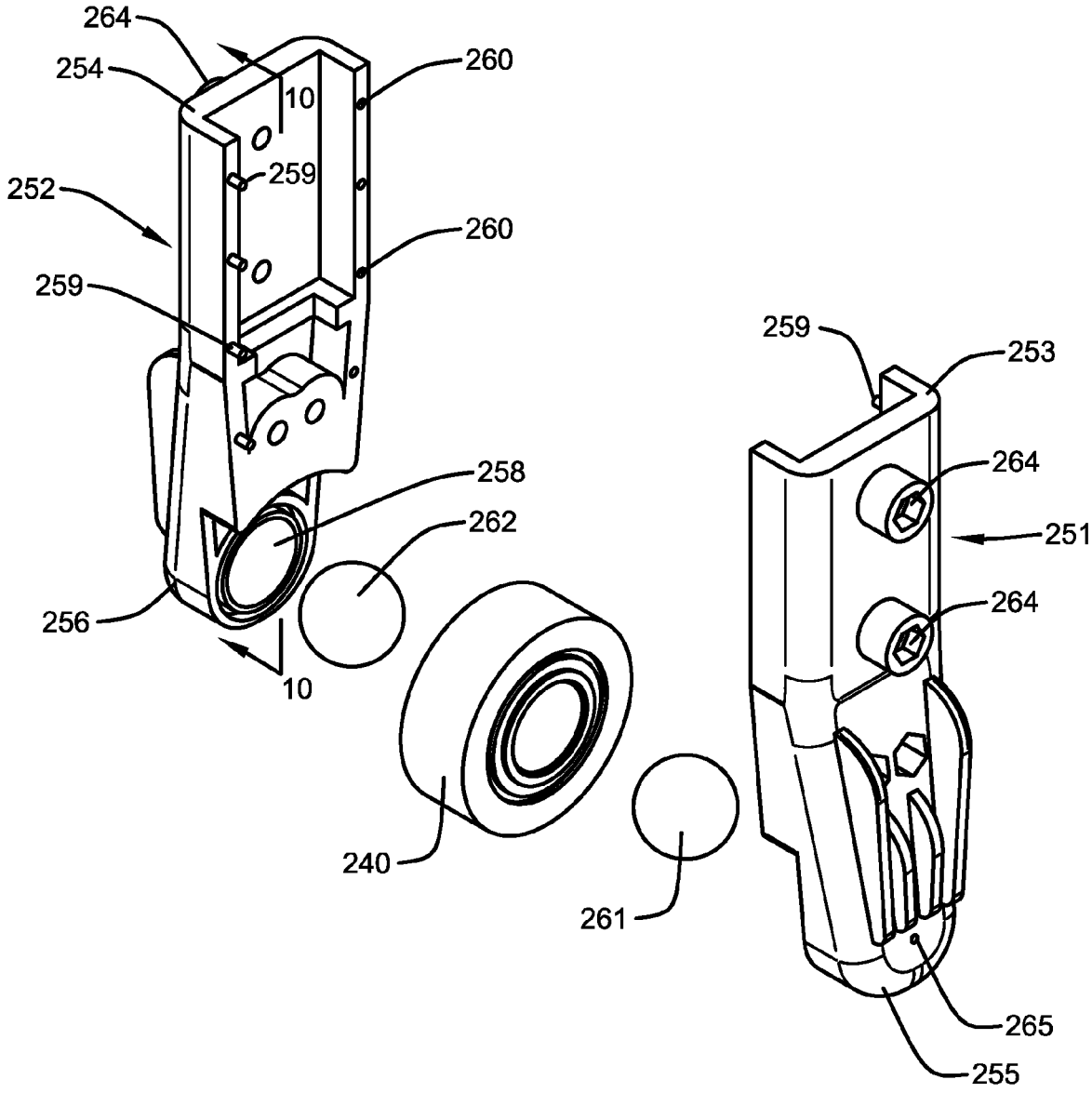
FIG. 9 is an exploded perspective view of the polishing wheel assembly of FIG. 6.
Figure 10:
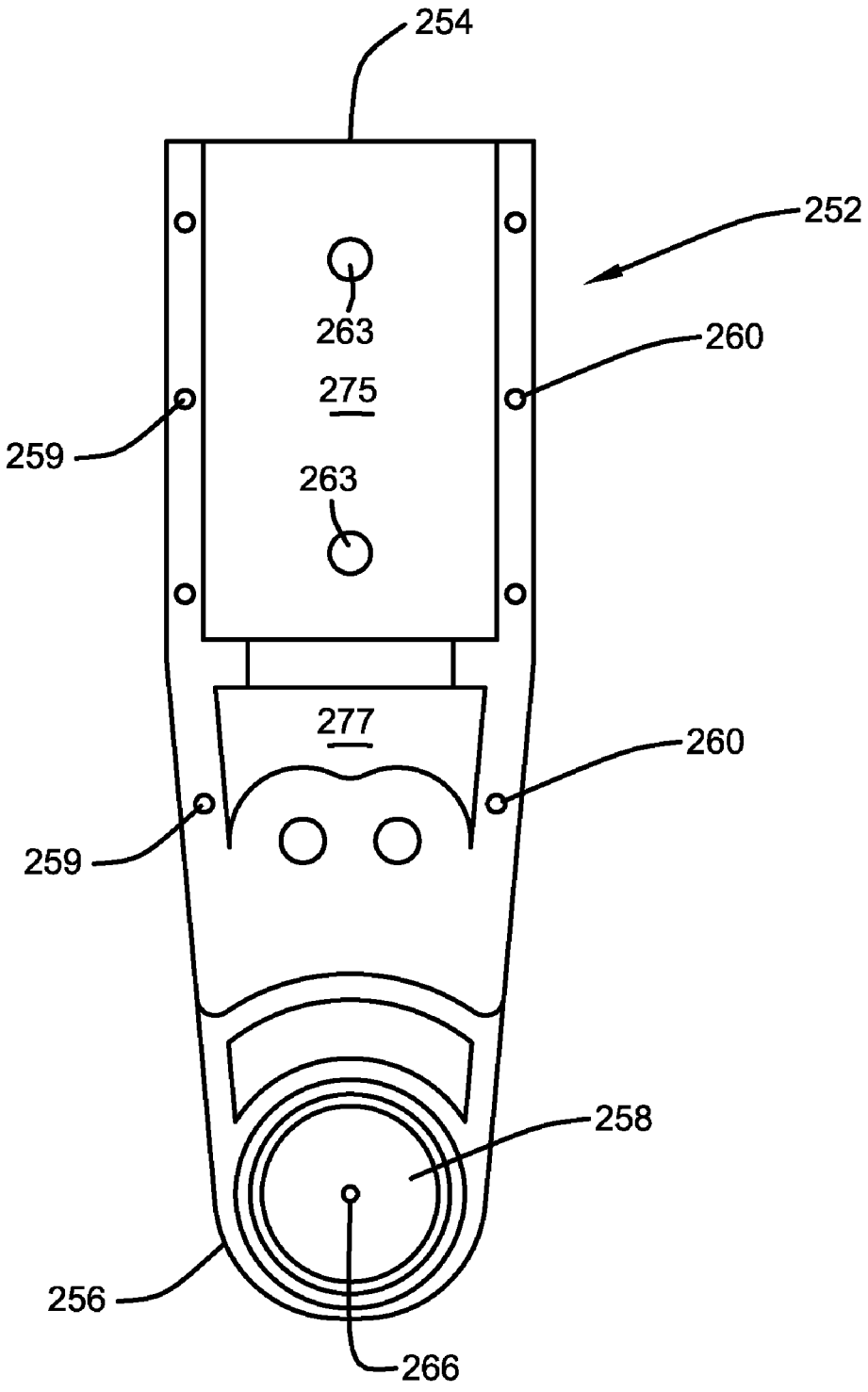
FIG. 10 is a front elevation view of the interior of one housing half of the polishing wheel assembly.
Figure 11:
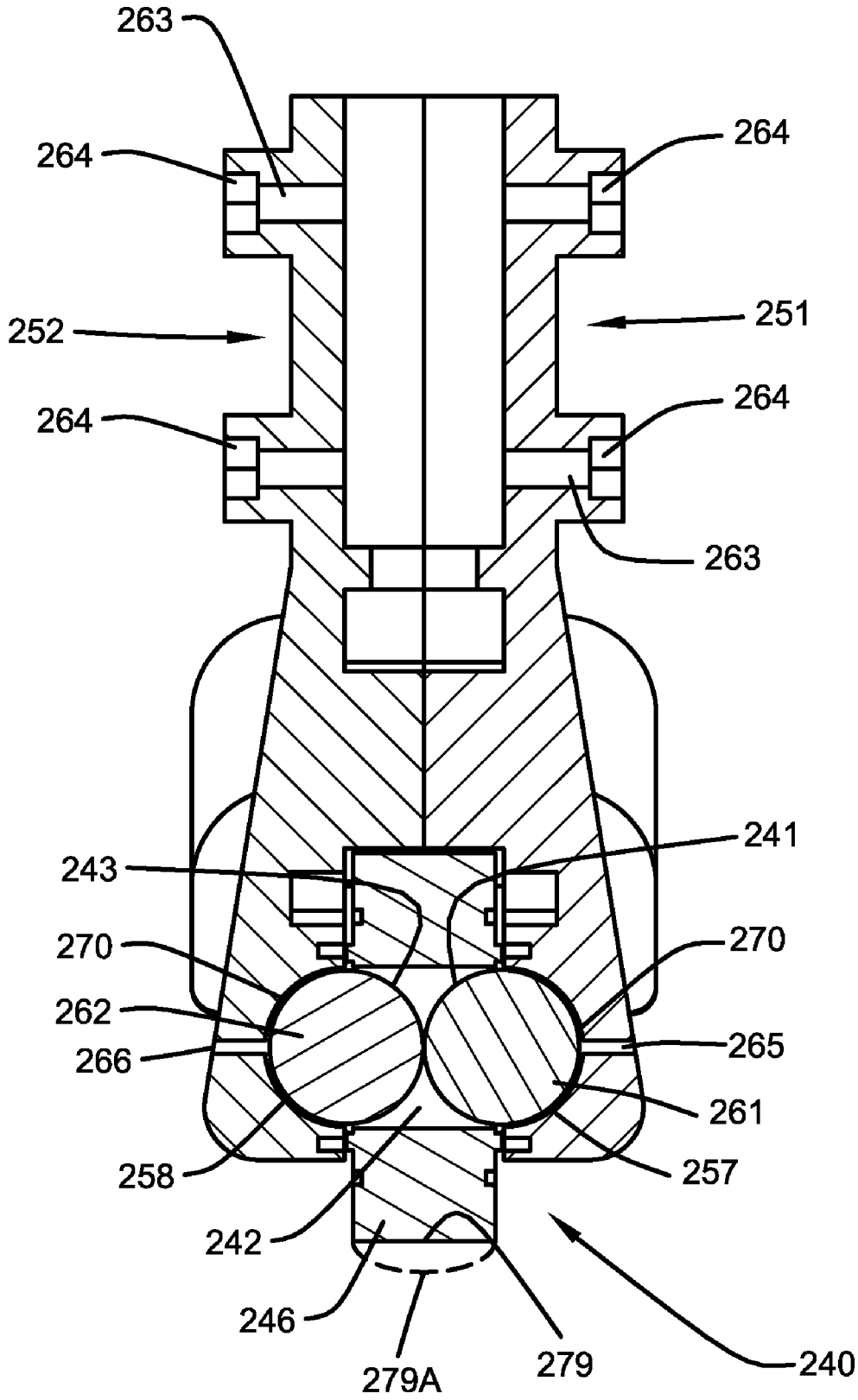
FIG. 11 is a cross-sectional view of the polishing wheel assembly, taken along line 11-11 of FIG. 8.

FIGS. 6-11 and FIGS. 12-13B of the instant application depict two alternative embodiments of polishing wheel assemblies that can be used with the applicants' polishing apparatus. More specifically, FIG. 6 is a perspective view of a first alternative polishing wheel assembly; FIG. 7 is a side elevation view of the polishing wheel assembly of FIG. 6, taken along the line 7-7 of FIG. 6; FIG. 8 is a front elevation view of the polishing wheel assembly of FIG. 6, taken along the line 8-8 of FIG. 6; FIG. 9 is an exploded perspective view of the polishing wheel assembly of FIG. 6; FIG. 10 is a front elevation view of the interior of one housing half of the polishing wheel assembly taken along line 10-10 of FIG. 9; FIG. 11 is a cross-sectional view of the polishing wheel assembly, taken along line 11-11 of FIG. 8.

Referring first to FIGS. 6-8, polishing wheel assembly 201 is comprised of a housing 250 comprising a first portion 251 and a second portion 252. First housing portion 251 comprises a proximal end 253 and a distal end 255, and second housing portion 252 comprises a proximal end 254 and a distal end 256. Referring also to FIGS. 9-11, each of the distal ends 255 and 256 include sockets 257 and 258 formed therein for holding ball bearings 261 and 262 therein. Polishing wheel 240 may be comprised of a rigid interior portion 242 including a first socket 241 and a second socket 243, and an elastic exterior portion 246, which may be formed of suitable elastomers such as rubber, polyurethane, or silicone, or a harder or higher durometer polymer. It is preferable that such elastomeric material be of a Shore A durometer between about 10 and about 90, with the particular durometer depending upon the polishing application. The elastic exterior portion 246 of polishing wheel 240 may be provided with a flat surface 279, or a generally arcuate surface 279A, which may be a spherical surface. Polishing belt 130, which is under tension, conforms to this surface 279/279A as it wraps around the perimeter of polishing wheel 240 during a polishing operation. This wrapping action results in better tracking of polishing belt 130 on polishing wheel 240. In addition, the radius of curvature and/or the curvature profile (spherical, elliptical, hyperbolic, etc.) of an arcuate surface 279A partially determines the tool spot size during a polishing operation, in combination with the hardness of elastic wheel portion 246 and the application force of polishing wheel 240 against the work piece 90 (FIG. 5).

A first ball bearing 261 is disposed between the socket 257 of the first housing portion 251 and the first socket 241 of the polishing wheel 240; and a second ball bearing 262 is disposed between the socket 258 of the second housing portion 252 and the second socket 243 of the polishing wheel 240. Polishing wheel 240 is thus suspended and rotatable between housing portions 251 and 252 by virtue of being supported by ball bearings 261 and 262.

The applicants' polishing wheel 240 is precisely suspended and runs with minimal friction or vibration, which is advantageous in performing highly precise polishing operations with the applicants' polishing assembly. In the embodiment of FIGS. 6-11, in which a pair of ball bearings are used, this precise suspension of the polishing wheel 240 is achieved by certain features of the housing portions 251 and 252, the polishing wheel 240, and the applicants' preferred process for fabricating the overall polishing wheel assembly.

The process comprises the first step of providing the housing portions 251 and 252, wherein when housing portions 251 and 252 are fastened to each other, the bearing sockets 257 and 258 are positioned opposite of each other. In one preferred embodiment depicted herein, housing portions 251 and 252 are made as half portions that are identical to each other. Referring to FIGS. 9 and 10, it can be seen that when identical housing halves 251 and 252 are turned to face each other, the housing halves can be joined together. Dowel pins 259 of one housing half are mated with dowel holes 260 of the opposite housing half to accurately align the two housing halves when they are joined to each other. Through holes 263, which are adjacent to hex sockets 264, are provided to accept threaded screws and hex nuts (not shown) for joining halves 251 and 252 to each other.

Wheel 240 and ball bearings 261 and 262 are also provided to form the wheel assembly 200. Referring in particular to FIG. 11, in an intermediate fabrication step, a moldable bearing material is provided in liquid or putty form, such bearing material being flowed into the sockets 257 and 258 of housing portions 251 and 252, and into the sockets 241 and 243 of polishing wheel 240. The ball bearings 261 and 262, coated with a slight amount of release agent such as a silicone oil, are placed in the sockets 241 and 243 of the polishing wheel 240, and then the wheel 240 and bearings 261 and 262 are placed in housing half 251 with bearing 261 in socket 257. Housing half 252 is temporarily fastened to housing half 251 with bearing 262 in socket 258. Any excess bearing material may be vented out through holes 265 and 266 of housing portions 251 and 252. Polishing wheel 240 may also be also provided with recesses for displacement of excess bearing material within wheel 240. The moldable bearing material 270 is allowed to cure into a hardened state.

Precise alignment of polishing wheel 240 within housing 250 may be further attained by the placement of a pair of O-rings (not shown) in O-ring grooves in housing portions 251 and 252, and O-ring grooves in wheel rim 242 as described in the applicants' aforementioned provisional patent application 60/746,346. These O-rings help to maintain a uniform separation gap between the polishing wheel 240 and the housing portions 251 and 252.

The moldable bearing material is preferably a hard, low friction material with self-lubricating properties. One preferred moldable bearing material is MOGLICE®, which is manufactured by Diamant Metallplastic GMBH of Moenchengaldbach West Germany. This material is provided in liquid or putty form, and cures into a hard solid material with a low coefficient of friction. One particular preferred formulation of MOGLICE® is Moglice Putty Hard, which is a no-slump putty that can be applied to vertical or overhead surfaces without running or dripping.

After the moldable bearing material 270 has fully cured, the housing portions 251 and 252 are separated from each other. Any small excess material that has extruded into the gap between the polishing wheel 240 and the housing portions 251 and 252 is trimmed or machined away. Additionally, the circular ring of contact between the ball bearings 261 and 262 and the sockets 241 and 243 of the polishing wheel 240 may also be machined slightly to be slightly recessed from the cured bearing material 270, so that the ball bearings 261 and 262 only run on the cured bearing material 270 when the polishing wheel assembly 201 is reassembled.

Thus by using the components of the applicants' polishing wheel assembly, along with a low-friction moldable bearing material, a highly precise, smoothly running durable assembly is made, without the requirement that the individual housing portions 251 and 252 and the polishing wheel 240 be made with high precision, which would make such components more costly.

Additional features of the housing portions 251 and 252 are now described. Referring to FIG. 10, housing portions 251 and 252 are provided with upper and lower recesses 275 and 277, which serve to improve melt flow and reduce the material usage when the housing portions are made of molded plastic or composite material. Additionally, when housing portions 251 and 252 are fitted together, the upper recesses 275 form a rectangular cavity which can accept support bar 234 (see FIG. 6), which is used to joint the polishing wheel assembly to base 110 (see FIG. 3).

Housing portions 251 and 252 may be made of any suitable rigid structural material. The housing portions are preferably made of a molded polymer material. In one preferred embodiment, housing portions 251 and 252 are made of glass fiber-reinforced acrylonitrile butadiene styrene (ABS.) Housing portions 251 and 252 may also be made of a metal such as aluminum, steel, stainless steel, or brass.

Figure 12:
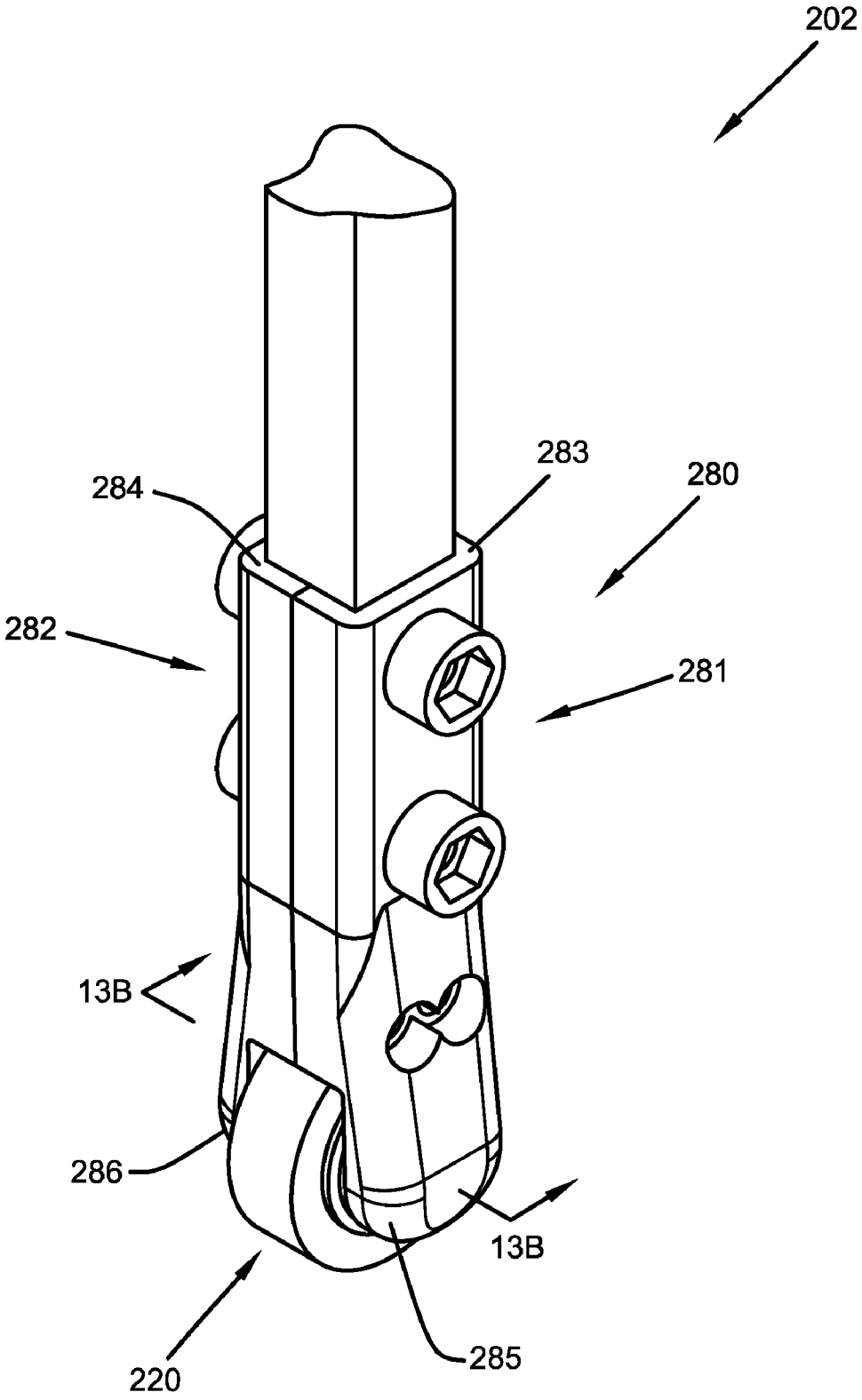
FIG. 12 is a perspective view of an alternative polishing wheel assembly comprising a pair or race-type bearings.
Figure 13A:
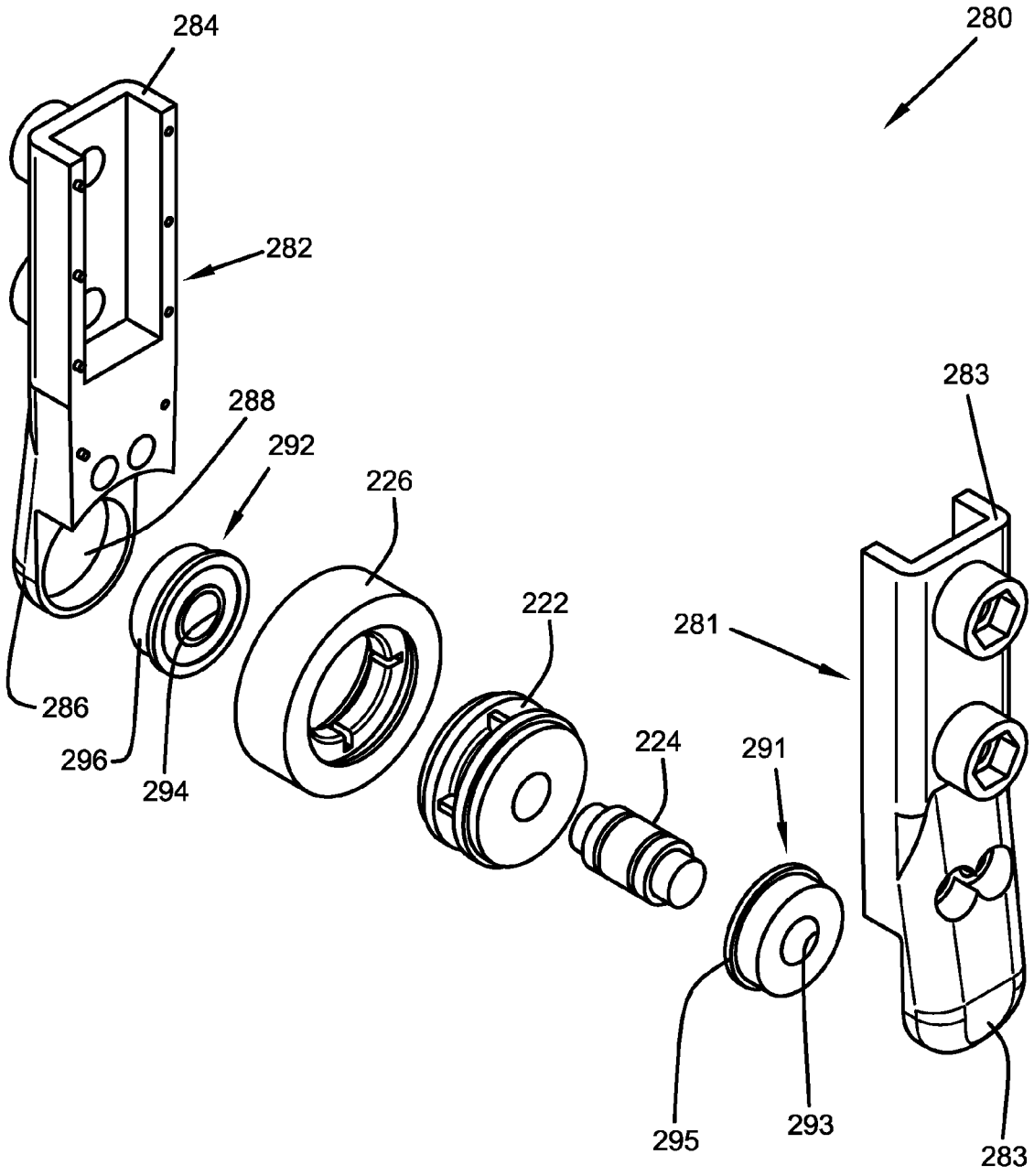
FIG. 13A is an exploded perspective view of the polishing wheel assembly of FIG. 12.
Figure 13B:
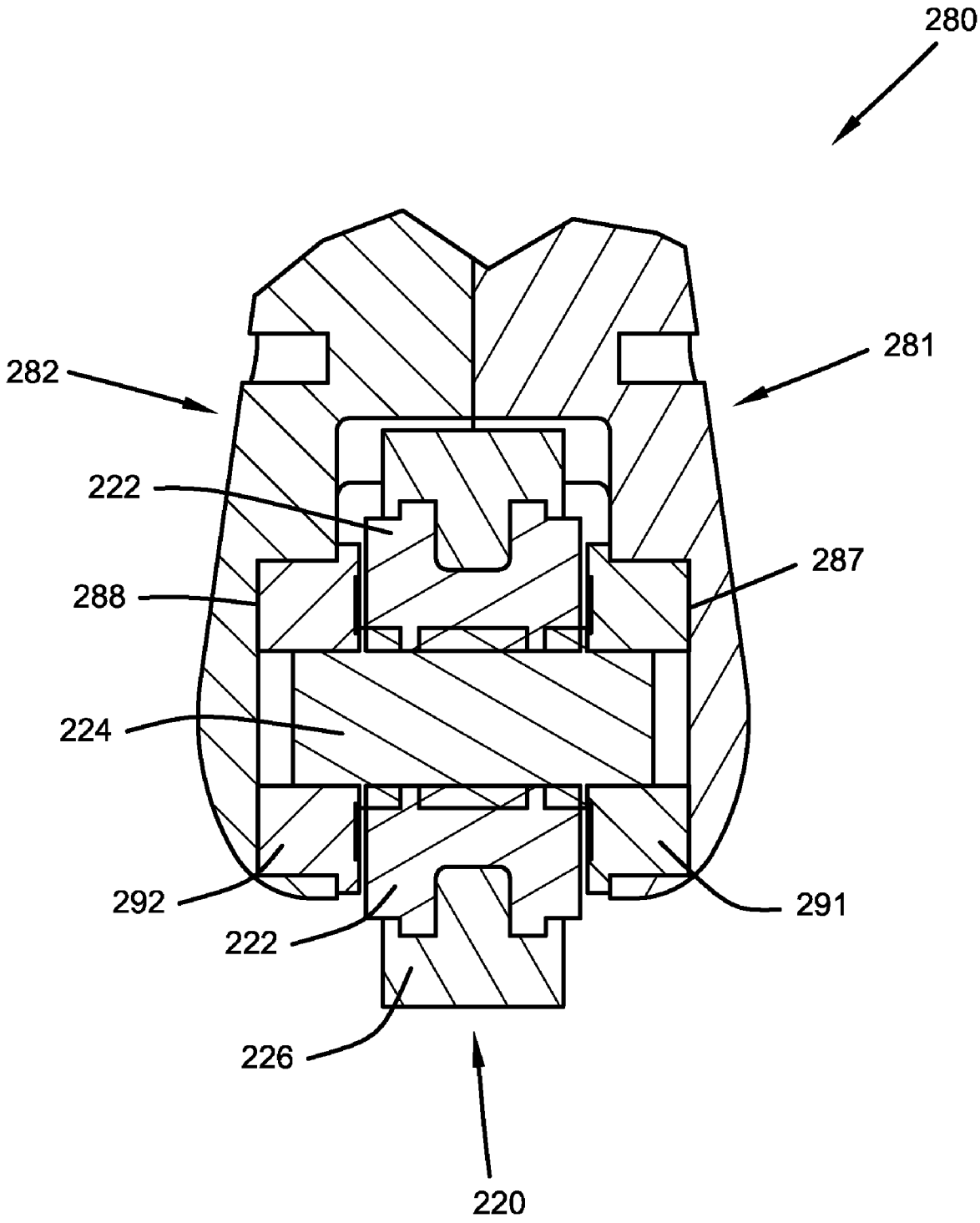
FIG. 13B is a cross-sectional view of the polishing wheel assembly of FIG. 12 taken along line 13B-13B of FIG. 12.

FIG. 12 is a perspective view of a second alternative polishing wheel assembly comprising a pair or race-type bearings; FIG. 13A is an exploded perspective view of the polishing wheel assembly of FIG. 12; and FIG. 13B is a cross-sectional view of the polishing wheel assembly of FIG. 12 taken along line 13B-13B of FIG. 12. Polishing wheel assembly 202 is comprised of a housing 280 comprising a first portion 281 and a second portion 282. First housing portion 281 comprises a proximal end 853 and a distal end 285, and second housing portion 282 comprises a proximal end 284 and a distal end 286. Each of the distal ends 285 and 286 include generally cylindrical sockets 287 and 288 formed therein for holding race-type bearings 291 and 292 therein.

Bearings 291 and 292 are comprised respectively of inner races 293 and 294, outer races 295 and 296, and a plurality of rolling members (not shown) contained within the bearing races. Polishing wheel 220 may be comprised of a rigid interior portion or hub 222, and an elastic exterior portion 226, which may be formed of suitable elastomers as described previously herein for polishing wheel 240. Polishing wheel 220 is further comprised of spindle 224, which is provided with a close-tolerance fit within hub 222 and within the inner races 293/294 of bearings 291/292, in order to enable smooth rotation of wheel 240. The perimeter of the polishing wheel 220 may be arcuate shaped, as described previously herein. The polishing wheel 220 may have an elongated barrel or cylindrical shape having a ratio of length to diameter greater than one.

The polishing apparatus may further include a dressing assembly including a stripping surface that is contactable with the outer surface of the polishing belt. The stripping surface may be a bar or stick of material or a rotating wheel that is applied to the polishing belt. In a preferred embodiment, the dressing assembly is comprised of a dressing belt having an outer surface that is the stripping surface. The dressing belt may be stored on and deployed from a supply spool and wound up on a take-up spool after engagement with the polishing belt outer surface.

Figure 14:
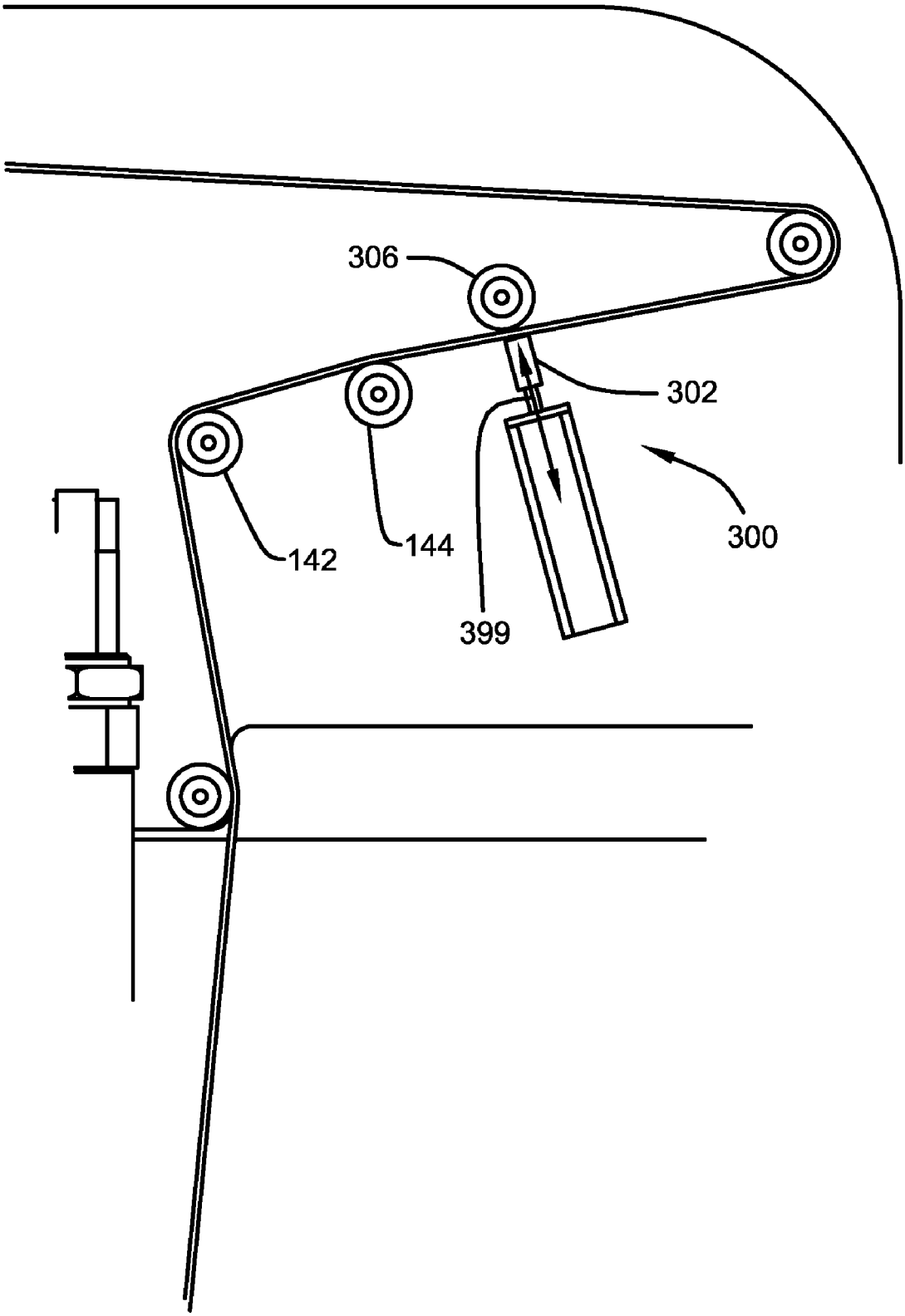
FIG. 14 is a side elevation view of a first device used to clean the polishing belt during operation of the polishing apparatus.

FIG. 14 is a side elevation view of a first device 300 (also shown in FIG. 3A) that is used to dress the polishing belt 130 during operation of the polishing apparatus. As used herein, the term "dressing a polishing belt" is meant to indicate a cleaning of the belt 130, wherein accumulated particles of material from the work piece 90 and/or a polishing slurry (if used) are dislodged from the rough abrasive outer surface 134 of the belt, so that the belt maintains its abrasive polishing capability. Referring to FIG. 14, dressing device 300 is comprised of an abrasive bar 302 that provides a stripping surface. Bar 302 is operatively connected to an actuator 304, and backing wheel 306. Abrasive bar 302 is movable by actuator 304 as indicated by bidirectional arrow 399. In FIG. 14, abrasive bar 302 is shown deployed against the abrasive surface 134 of belt 130. At the startup of the polishing process, prior to the contacting of the polishing belt with the work piece, belt 130 may be dressed by abrasive bar 304. The bar is then retracted from the belt and polishing proceeds. The belt may be further dressed intermittently during the polishing process.

Figure 15A:
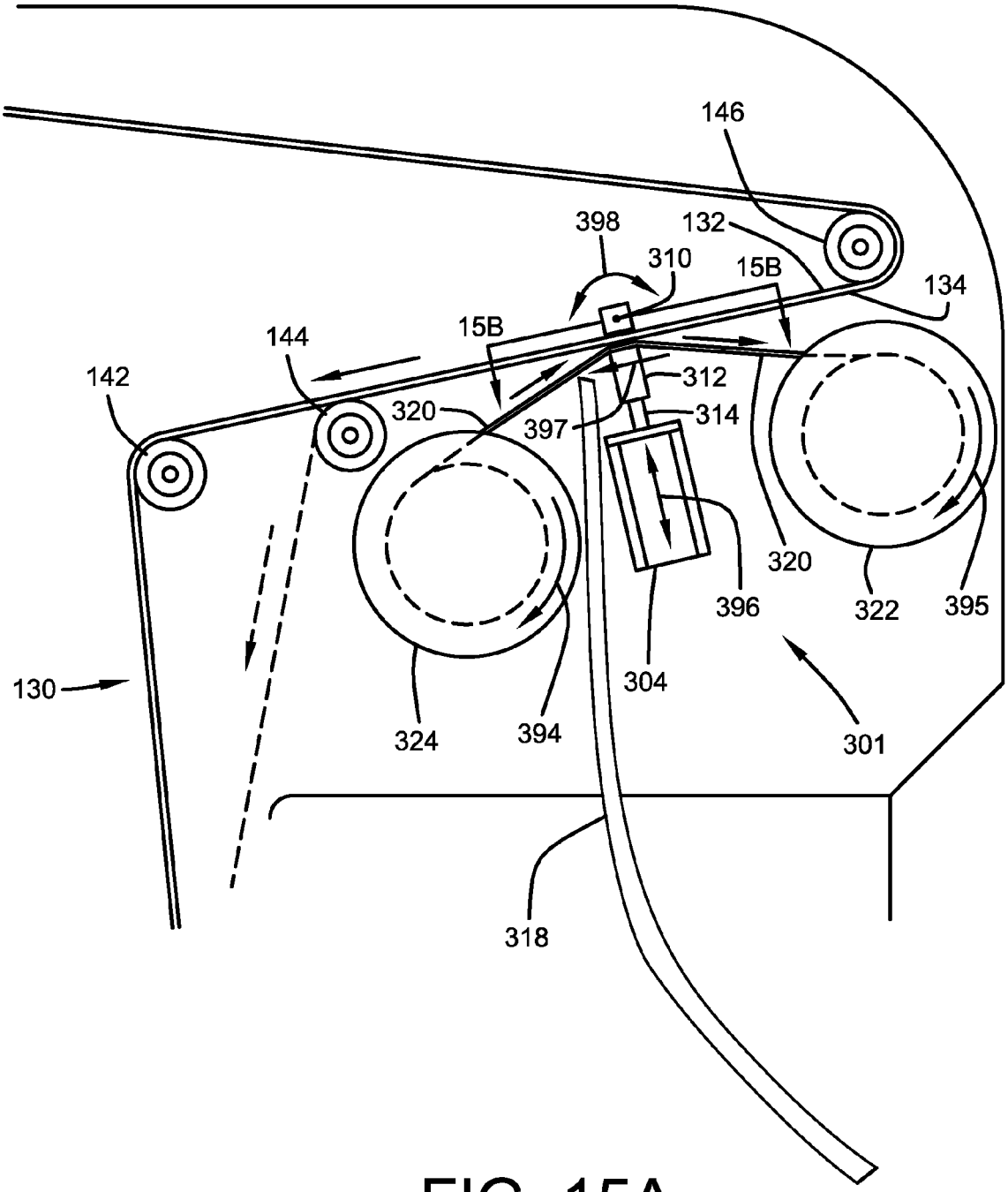
FIG. 15A is a side elevation view of a second device and a third device used to clean the polishing belt during operation of the polishing apparatus.

In an alternate embodiment, backing wheel 306 may be replaced by a backing block 308 (see FIG. 15A). Backing block 308 is partially rotatable around mounting pin 310, so that surface 311 of backing block 310 aligns with belt 130 and abrasive bar 302. In one embodiment, abrasive bar 302 may be made of alumina or silicon carbide.

Figure 15B:
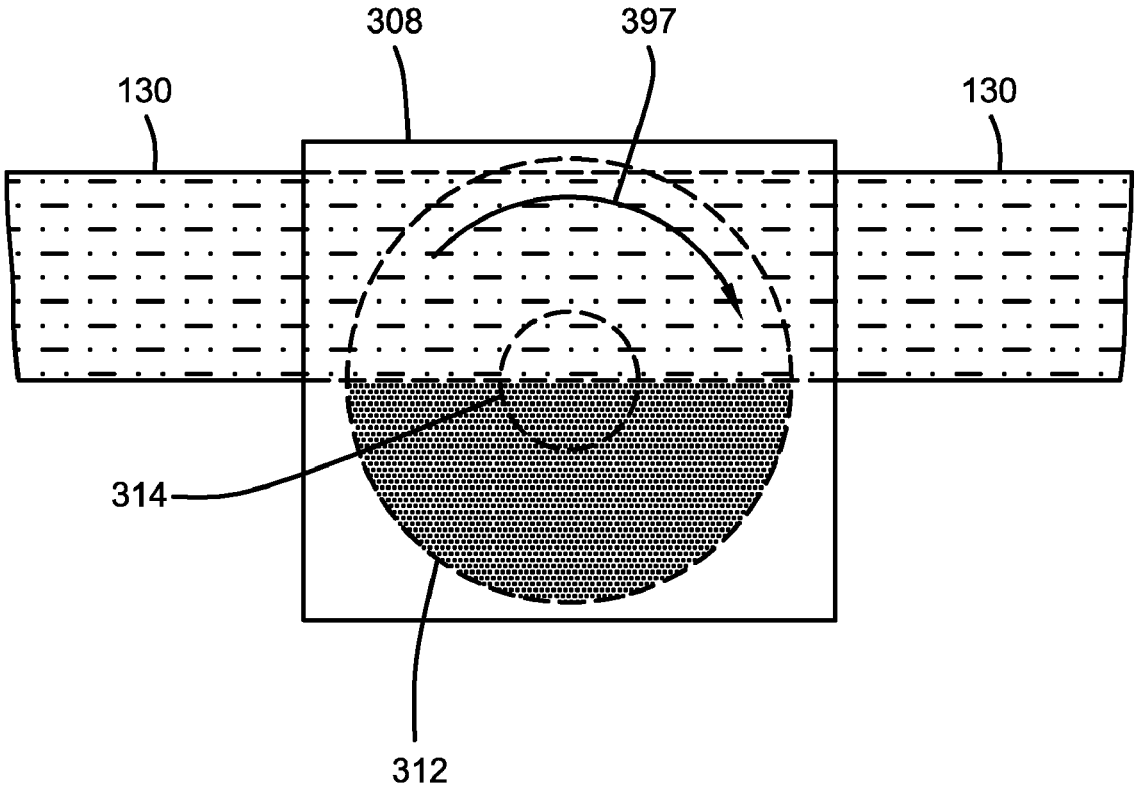
FIG. 15B is a top view of the second device of FIG. 15A, taken along the line 15B-15B of FIG. 15A.

FIG. 15A is a side elevation view of a second device 301 (also shown in FIG. 3B) that may be configured in at least two ways to clean the polishing belt during operation of the polishing apparatus, and FIG. 15B is a top view of the device of FIG. 15A, taken along the line 15B-15B of FIG. 15A. In one configuration, dressing device 301 is comprised of dressing wheel 312 that provides a stripping surface against the outer surface 134 of belt 130. Dressing wheel 312 is operatively connected by shaft 314 to motor 316. During a belt dressing operation, dressing wheel 312 is rotated by motor 316 as indicated by arrow 397. Alternatively, wheel 312 may be driven by the motion of the belt 130, similar to methods used in brake dressing. In this embodiment, an adjustable tension or drag is applied to the wheel 312 or shaft 314, which minimizes its ability to rotate as fast as belt 130 would spin wheel 312 if no drag were present.

Dressing wheel 312 and motor 316 are movable by actuator 304 as indicated by bidirectional arrow 396. In FIG. 15A, dressing wheel 312 is shown slightly retracted from the abrasive surface 134 of belt 130. At the startup of the polishing process, prior to the contacting of the polishing belt 130 with the work piece 90, belt 130 may be dressed by dressing wheel 312 by deploying dressing wheel 312 against the abrasive surface 134 of belt 130. The inner surface 132 of belt 130 runs against surface 311 of backing block 310 during the dressing operation. The dressing wheel 312 is then retracted from the belt and polishing proceeds. The belt 130 may be further dressed intermittently during the polishing process. Suitable materials for dressing wheel 312 include porous ceramic materials such as alumina, which is typically used in cylindrical grinding stones.

FIG. 15A also depicts a second configuration of dressing device 301 which includes a dressing belt that is unwound from a supply spool, applied to the polishing belt to dress it, and wound up on a windup spool. The dressing belt provides a stripping surface against the outer surface 134 of belt 130. In this embodiment, object 312 is not a dressing wheel. Instead, object 312 is a rectangular block of material with an upper surface that is substantially the same shape as the lower surface of backing block 310. At the startup of the polishing process, prior to the contacting of the polishing belt 130 with the work piece 90, belt 130 may be dressed between backing block 310 and dressing block 312. Dressing block 312 is deployed upwardly, displacing dressing belt 320 against the abrasive surface 134 of belt 130. The inner surface 132 of belt 130 runs against surface 311 of backing block 310 during the dressing operation, while the outer surface 134 of belt 130 runs against a corresponding portion of dressing belt 320 that functions as a stripping surface. The dressing block 312 is then retracted from the belt and polishing proceeds.

The belt 130 may be further dressed intermittently during the polishing process. A fresh section of stripping surface on dressing belt 320 can be provided by rotationally indexing windup spool 322 and supply spool 324 as indicated by arcuate arrows 395 and 394. Referring also to FIG. 3A, windup spool 322 may be driven by suitable means, such as by motor 326, speed reducer 328, and drive belt 330 that is engaged with windup spool 322.

In a further embodiment, polishing apparatus is provided with a vacuum tube 318, which is located in close proximity to the dressing device 301. Vacuum tube 318 evacuates any particulate matter that is dislodged from belt 130 during the dressing operation.

Figure 16:
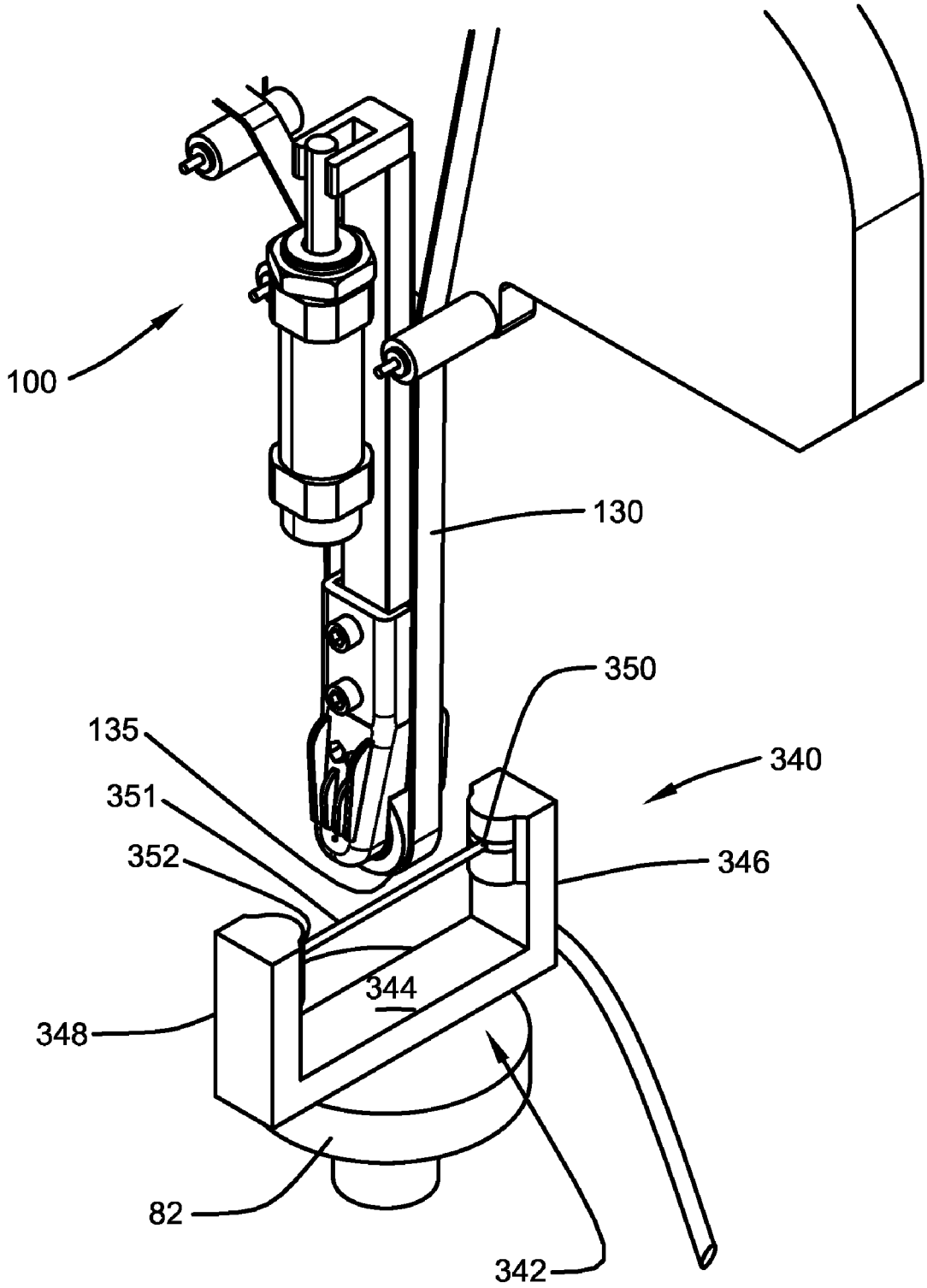
FIG. 16 is a perspective view of a position measurement device for detecting the polishing wheel of the apparatus to an object to be polished.

FIG. 16 is a perspective view of an position measurement device for aligning and/or detecting the position of the polishing wheel of the apparatus to an object to be polished. Position measuring device 340 is comprised of a U-shaped housing 342 that includes a horizontal base 344, a first upright housing member 346, and a second upright housing member 348. A laser 350 is contained in first upright housing member 346, and a photodetector is contained in second upright housing member 348. In performing an position measuring operation, position measuring device 340 is placed upon the upper surface of spindle 82. Laser 350 emits laser beam 351 toward photodetector 352. When the path from laser 350 to photodetector 352 is unobstructed, photodetector 352 detects laser beam 351. Polishing assembly 100 may be slowly lowered by CNC machine 10 (see FIG. 1) such that the lower edge 135 of polishing belt 130 breaks laser beam 351. This interruption of beam 351 is detected by photodetector 352, and the precise location of the polishing spot portion of polishing belt 130 is thus detected, and can then be programmed into the system to perform a polishing operation. In one embodiment, position measuring device 340 may be purchased as a fully assembled unit, such as a Mida series laser manufactured by Marposs S.p.A. of Bentivoglio, Italy.

Figure 17:
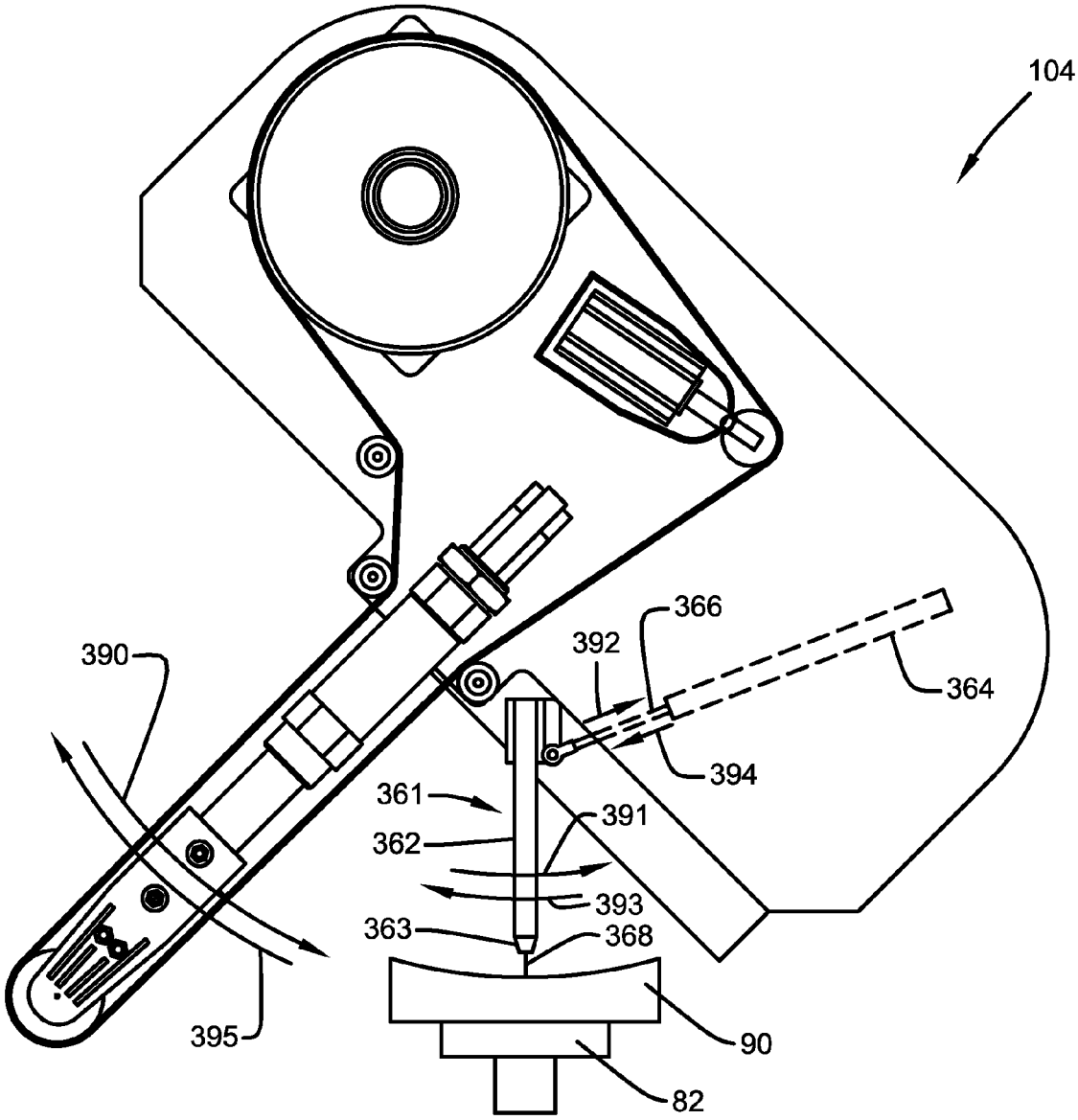
FIG. 17 is a front elevation view of the polishing apparatus of FIG. 3B, depicting a spot testing device of the polishing apparatus.

FIG. 17 is a front elevation view of the polishing apparatus of FIG. 3B, depicting a spot testing device of the polishing apparatus. Referring to FIGS. 3B and 17, polishing apparatus 104 (or apparatus 100-103 of FIGS. 1-3A) may further include a polishing spot measurement tool 360 comprised of a "light pen" 361 including deployable housing 362 containing a light source and a light detector. Deployable housing may be deployed and retracted by actuator 364. When tool 360 is not in use, deployable housing 362 is retracted up to the horizontal position along the lower portion of base 110, as shown in FIG. 3B. The measurement is a non-contact, i.e. the light pen does not touch the surface of the polished spot being measured.

Spot testing device can be used to perform a spot measurement as follows. When apparatus 104 is fully set up for polishing, the polishing belt 130 running on polishing wheel 240 is contacted briefly with the work piece 90 under precisely controlled conditions, thereby making a slight generally elliptical shaped polished test spot on work piece 90. Apparatus 104 is then raised, withdrawing polishing belt 130 from contact with work piece 90, and apparatus 104 is rotated by turret 70 as indicated by arcuate arrow 395. Actuator 364 deploys housing 362 via motion of rod 366 as indicated by arrow 394 and arcuate arrow 393 to a substantially vertical position. Housing 362 is positioned so that the distal end 363 thereof is proximate to or directly above the test spot in work piece 90. The light source (not shown) within housing 362 is energized, and light beam 368 is directed to or near the test spot. Light is reflected back from work piece 90, back into housing 362 to a light detector contained therein.

The spectral content of back reflected light varies from the region outside of the spot, and within the spot, and is also dependent upon the depth of removal within the spot. By scanning the light pen 361 over the region of the test spot using a control program of CNC machine 10 (FIG. 1), the shape and spatial depth variation of the spot can be measured. The overall rate of material removal of the apparatus 104 can thus be calculated, and used to program an overall deterministic finishing process for the work piece 90 to be executed by CNC machine 10.

When the spot measurement is completed, the housing 362 of light pen 361 is retracted back to the horizontal position along the lower portion of base 110, as shown in FIG. 3B, as indicated by arrows 391 and 392. Apparatus 104 is rotated back to a polishing position by turret 70 as indicated by arcuate arrow 390.

In one embodiment, light pen 361 may be purchased as a fully assembled unit, such as a Model CHR150, manufactured by Stil S. A. of Aix en Provence, France.

It is, therefore, apparent that there has been provided, in accordance with the present invention, an apparatus and methods for polishing of optics and other objects having high precision surfaces. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A method for polishing objects, comprising:

a. providing a polishing apparatus comprised of:

i. a rotary positioning device comprising a turret rotatable around a turret axis;

ii. a base for affixing structures thereto, the base mounted on the turret and comprising a plate having a surface defining a plane perpendicular to the turret axis;

iii. a drive wheel connected to a rotatable shaft, the drive wheel having a perimeter, and the rotatable shaft disposed in a housing joined to the plate and having a rotational axis that is substantially parallel to the turret axis; and iv. a polishing wheel assembly comprising an elongated arm including a proximal end joined to the base, and a distal end; a rotatable polishing wheel supported at the distal end of the elongated arm, the rotatable polishing wheel having a perimeter; and a polishing belt comprising an inner surface and an outer surface, the inner surface engageable with the perimeters of the drive wheel and the polishing wheel;

b. contacting the outer surface of the polishing belt to a contact region of the surface of the object; and c. controlling the contact region by rotating the elongated arm around the turret axis.

2. The method of claim 1, further comprising moving the apparatus in a linear path with respect to the object.

3. The method of claim 2, further comprising superimposing a circular motion on the linear path.

4. The method of claim 1, further comprising moving the apparatus with respect to the object in a path selected from arcuate, zigzag, sinusoidal, and combinations thereof.

5. The method of claim 1, further comprising holding the object stationary during polishing.

6. The method of claim 1, further comprising rotating the object during polishing.

7. The method of claim 6, further comprising varying the rotational speed of the object during polishing.

8. The method of claim 1, further comprising measuring the object to be polished prior to polishing, and determining polishing process parameters for operation of the apparatus during polishing.

9. The method of claim 1, wherein the polishing belt is a continuous loop of belt, and the method further comprises driving the continuous loop of belt in repeated cycles around the perimeters of the drive wheel and the polishing wheel.

10. The method of claim 1, wherein the polishing belt is wound on a first spool, and the method further comprises unwinding the belt from the first spool, around a portion of the perimeter of the polishing wheel, and winding the belt onto a second spool.

11. The method of claim 1, further comprising delivering a liquid to the contact region during polishing.

12. The method of claim 1, wherein the apparatus is further comprised of a dressing assembly including a stripping surface that is contactable with the outer surface of the polishing belt, and the method further comprises dressing the polishing belt with the stripping surface.

13. The method of claim 12, wherein the dressing assembly is comprised of a dressing belt having a surface that is the stripping surface and the method further comprises contacting the stripping surface of the dressing belt with the outer surface of the polishing belt.

14. The method of claim 12, wherein the dressing assembly is comprised of an abrasive bar having a surface that is the stripping surface and the method further comprises contacting the stripping surface of the abrasive bar with the outer surface of the polishing belt.

15. The method of claim 12, wherein the dressing assembly is comprised of a dressing wheel having a surface that is the stripping surface and the method further comprises contacting the stripping surface of the dressing wheel with the outer surface of the polishing belt.

16. The method of claim 1, wherein the apparatus is further comprised of a position measuring device comprising a laser and a photodetector, and the method further comprises measuring the position of the polishing wheel with respect to the object.

17. The method of claim 16, further comprising adjusting a parameter of the polishing apparatus after measuring the position of the polishing wheel with respect to the object.

18. The method of claim 1, wherein the apparatus is further comprised of a polishing spot measurement tool comprising a housing containing a light source and a light detector, and the method further comprises measuring the contact region between the polishing belt and the surface of the object.

19. The method of claim 18, wherein the housing of the spot measurement tool is deployable and retractable, and the method further comprises deploying the spot measurement tool, measuring the contact region, and retracting the spot measurement tool.

20. The method of claim 18, further comprising adjusting a parameter of the polishing apparatus after measuring the contact region.

* * * * *